US008860646B2

(12) United States Patent
Nishi et al.

(10) Patent No.: US 8,860,646 B2
(45) Date of Patent: Oct. 14, 2014

(54) LIQUID CRYSTAL DISPLAY DEVICE

(75) Inventors: Shuji Nishi, Osaka (JP); Seijirou Gyouten, Osaka (JP); Yuhichiroh Murakami, Osaka (JP); Shige Furuta, Osaka (JP); Yasushi Sasaki, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 309 days.

(21) Appl. No.: 13/395,716

(22) PCT Filed: May 18, 2010

(86) PCT No.: PCT/JP2010/058383

§ 371 (c)(1),
(2), (4) Date: Mar. 13, 2012

(87) PCT Pub. No.: WO2011/033822

PCT Pub. Date: Mar. 24, 2011

(65) Prior Publication Data

US 2012/0169580 A1 Jul. 5, 2012

(30) Foreign Application Priority Data

Sep. 16, 2009 (JP) ..... 2009-215070

(51) Int. Cl.
*G09G 3/36* (2006.01)

(52) U.S. Cl.
CPC ..... *G09G 3/3618* (2013.01); *G09G 2300/0852* (2013.01); *G09G 3/3659* (2013.01); *G09G 3/3614* (2013.01); *G09G 2300/0823* (2013.01)
USPC ..... 345/98; 345/87; 345/94; 345/99

(58) Field of Classification Search
CPC ..... G09G 3/3618; G09G 2300/0426; G09G 2300/0439; G09G 2300/0842; G09G 2300/0852
USPC ..... 345/87–104
See application file for complete search history.

(56) References Cited

U.S. PATENT DOCUMENTS

| | | | | |
|---|---|---|---|---|
| 5,182,661 | A * | 1/1993 | Ikeda et al. | 349/38 |
| 7,230,597 | B2 * | 6/2007 | Edwards et al. | 345/87 |
| 2002/0075205 | A1 * | 6/2002 | Kimura et al. | 345/55 |
| 2002/0089481 | A1 | 7/2002 | Tsutsui et al. | |
| 2002/0180675 | A1 | 12/2002 | Tobita et al. | |
| 2003/0174116 | A1 | 9/2003 | Maeda et al. | |

FOREIGN PATENT DOCUMENTS

| | | | |
|---|---|---|---|
| JP | 2002174824 | A | 6/2002 |
| JP | 2002-229532 | A | 8/2002 |
| JP | 2002351430 | A | 12/2002 |

OTHER PUBLICATIONS

International Search Report and Written Opinion of Searching Authority.

* cited by examiner

*Primary Examiner* — Ilana Spar
(74) *Attorney, Agent, or Firm* — Harness, Dickey & Pierce

(57) ABSTRACT

A memory liquid crystal display device includes a transistor (N1), a transistor (N2), a transistor (N3), a transistor (N4), a first storage capacitor (storage capacitor of an overlapping part of a capacitor electrode 37*a* and a CS line CSL(i)) connected to a pixel electrode (7), and a second storage capacitor (storage capacitor of an overlapping part of a capacitor electrode 37*b* and a CS extension section 10*bb*) connected to the pixel electrode (7) via the transistor (N2), the pixel electrode (7) being connected to (a) a source line (SL(j)) via the transistor (N1), (b) a data transfer control line (DT(i)) via the transistor (N4) and the third transistor, (c) a drain electrode (9*a*) of the transistor (N1) via a contact hole (13), and (d) a source electrode (8*b*) of the transistor (N2) and to a drain electrode (9*c*) of the transistor (N4), via a contact hole (14). This allows for improving a yield rate and for reducing malfunction caused by noise generated between signal lines, in a memory liquid crystal display device.

2 Claims, 19 Drawing Sheets

LIQUID CRYSTAL DISPLAY DEVICE

TECHNICAL FIELD

The present invention relates to a memory liquid crystal display device.

BACKGROUND ART

A memory liquid crystal display device is a liquid crystal display device which once holds image data written into its pixels and thereafter displays the image data by carrying out a refresh operation while inverting the polarity of the image data (memory operation mode). In regular operation (normal operation mode, multicolor display mode) in which multicolor (multiple tone) display is carried out, the pixels are rewritten with new image data per frame via a data signal line, whereas in the memory operation mode, since the image data held in a memory circuit (pixel memory) is used, there is no need to supply, to the data signal line, image data for rewriting images, while the refresh operation is being carried out.

Accordingly, since the memory operation mode allows for stopping the operation of the circuit that drives the scanning signal lines and data signal lines, power consumption can be reduced. Furthermore, it is possible to reduce power consumption by (i) reducing the number of times a data signal line having a large capacity is charged and discharged and (ii) not requiring transmitting to a controller of image data that corresponds to the memory operation period.

Hence, the memory operation mode is often used for an image display which strongly requires low power consumption, such as a standby screen display of a portable phone.

FIG. 15 extracts and illustrates just a memory circuit part of a configuration of pixels in a memory liquid crystal display device as such. In a case where the pixel configuration is to be functioned also as pixels of a liquid crystal display device, assume that a liquid crystal capacitor Clc is added to the configuration, as illustrated in the broken lines in FIG. 15. A pixel configuration as such is equal to that disclosed in, for example, Patent Literature 1.

A memory circuit MR100 serving as the memory circuit part includes a switch circuit SW100, a first data storage section DS101, a data transfer section TS100, a second data storage section DS102, and a refresh output control section RS100.

The switch circuit SW100 is made up of a transistor N100 which is an N-channel TFT. The first data storage section DS101 is made up of a capacitor Ca100. The data transfer section TS100 is made up of a transistor N101 which is an N-channel TFT. The second data storage section DS102 is made up of a capacitor Cb100. The refresh output control section RS100 is made up of an inverter INV100 and a transistor N103 which is an N-channel TFT. The inverter INV100 is made up of a transistor P100 which is a P-channel TFT, and a transistor N102 which is an N-channel TFT.

Moreover, as a signal line for driving the memory circuit MR100, a data transfer control line DT100, a switch control line SC100, a high power line PH100, a low power line PL100, a refresh output control line RC100, and a capacitor line CL100 are provided for each row in a pixel matrix, and a data input line IN100 is provided for each column in the pixel matrix.

Moreover, one of drain/source terminals of a field-effect transistor such as the TFT is called a first drain/source terminal, and the other one of the drain/source terminals is called a second drain/source terminal. However, whenever it is possible to set as either one of the drain terminal or source terminal based on the direction that the electric current can flow between the first drain/source terminal and the second drain/source terminal, the terminals are called by their respective drain terminal or source terminal. A gate terminal of the transistor N100 is connected to the switch control line SC100, a first drain/source terminal of the transistor N100 is connected to the data input line IN100, and a second drain/source terminal of the transistor N100 is connected to a node PIX which is one end of the capacitor Ca100. The other end of the capacitor Ca100 is connected to the capacitor line CL100.

A gate terminal of the transistor N101 is connected to the data transfer control line DT100, a first drain/source terminal of the transistor N101 is connected to the node PIX, and a second drain/source terminal of the transistor N101 is connected to a node MRY that is one end of the capacitor Cb100. The other end of the capacitor Cb100 is connected to the capacitor line CL100.

An input terminal IP of the inverter INV100 is connected to the node MRY. A gate terminal of the transistor P100 is connected to the input terminal IP of the inverter INV100, a source terminal of the transistor P100 is connected to the high power line PH100, and a drain terminal of the transistor P100 is connected to an output terminal OP of the inverter INV100. A gate terminal of the transistor N102 is connected to the input terminal IP of the inverter INV100, a drain terminal of the transistor N102 is connected to the output terminal OP of the inverter INV100, and a source terminal of the transistor N102 is connected to the low power line PL100. A gate terminal of the transistor N103 is connected to the refresh output control line RC100, a first drain/source terminal of the transistor N103 is connected to the output terminal OP of the inverter INV100, and a second drain/source terminal of the transistor N103 is connected to the node PIX.

In a case where the liquid crystal capacitor Clc is to be provided to the memory circuit MR100 to have the memory circuit serve as a pixel, the liquid crystal capacitor Clc is to be connected between the node PIX and a common electrode COM.

Next describes an operation of the memory circuit MR100, with reference to FIG. 16.

In FIG. 16, the memory circuit MR100 is in the memory operation mode such as a standby state of a portable phone. On the data transfer control line DT100, the switch control line SC100, and the refresh output control line RC100, a potential of a binary level consisted of High (active level) and Low (non-active level) is applied from a drive circuit not illustrated. The High and Low levels of the voltage of the binary level may be set separately per line. To the data input line IN100, a binary logic level consisted of High and Low is outputted from a drive circuit not illustrated. A potential supplied by the high power line PH100 is equal to the binary logic level of High, and a potential supplied by the low power line PL100 is equal to the binary logic level of Low. A potential supplied by the capacitor line CL100 may be fixed or may vary at a given timing, however for easy explanation, the potential is fixed.

A write-in period T101 and a refresh period T102 are provided in the memory operation mode. The write-in period T101 is a period in which data to be held in the memory circuit MR100 is written in, and includes a period t101 and a period t102, consecutive in this order. In the write-in period T101, the data is written in line sequentially onto the memory circuit MR100. Hence, an end timing of the period t101 is provided for each row, within a period in which the write-in data corresponding to that row is outputted. The end timing of period t102, i.e., the end timing of the write-in period T101 is the same for all rows. The refresh period T102 is a period which holds data written onto the memory circuit MR100 in the write-in period T101, while refreshing the data; the refresh period 102 starts all at once for all rows and includes periods t103 to t110 that are consecutive in this order.

In the write-in period T101, the switch control line SC100 has a potential of High in the period t101. The data transfer control line DT100 and the refresh output control line RC100 have a potential of Low. This makes the transistor N100 be in an ON state, and thus a data potential (in this case, High) supplied to the data input line IN100 is written into the node PIX. In the period t102, the potential of the switch control line SC100 is Low. This switches the transistor N100 to an OFF state, and thus an electric charge corresponding to the data potential written in is held at the capacitor Ca100.

If the memory circuit MR100 is consisted of just the capacitor Ca100 and the transistor N100, the node PIX is in a floating state while the transistor N100 is in the OFF state. Ideally at this time, an electric charge is held at the capacitor Ca100 so that a potential of the node PIX is maintained as High. However, an actual case is that off state leakage current occurs with the transistor N100; the electric charge of the capacitor Ca100 gradually leaks outside the memory circuit MR100. Leakage of the electric charge of the capacitor Ca100 causes the potential of the node PIX to change; if the electric charge leaks for a long period of time, the potential of the node PIX changes to the degree that the data potential written in loses its original meaning.

Accordingly, the data transfer section TS100, the second data storage section DS102, and the refresh output control section RS100 are functioned so that the potential of the node PIX is refreshed and the data written in is not lost.

In order to do so, the refresh period T102 follows. In the period t103, the potential of the data transfer control line DT100 becomes High. This causes the transistor N101 to switch to the ON state, which connects the capacitor Ca100 with the capacitor Cb100 in parallel via the transistor N101. The capacitor Ca100 has its capacitance set greater than that of the capacitor Cb100. Consequently, a potential of the node MRY is made High by the movement of electric charge between the capacitor Ca100 and the capacitor Cb100. A positive electric charge moves from the capacitor Ca100 to the capacitor Cb100 via the transistor N101, until the potential of the node MRY becomes equal to the potential of the node PIX. Consequently, although the potential of the node PIX is decreased by a slight amount of voltage ΔV1 than that of the period t102, the potential is within the range of the High potential.

In the period t104, the potential of the data transfer control line DT100 becomes Low. Since this causes the transistor N101 to switch into an OFF state, an electric charge is held at the capacitor Ca100 so that the potential of the node PIX is maintained as High and an electric charge is held at the capacitor Cb100 so that the potential of the node MRY is maintained as High.

In the period t105, the potential of the refresh output control line RC100 becomes High. This switches the transistor N103 to the ON state, which thus connects the output terminal OP of the inverter INV100 to the node PIX. The output terminal OP outputs an inverted potential (Low in this case) of the potential of the node MRY, so the node PIX is charged by the inverted potential. In the period t106, the potential of the refresh output control line RC100 becomes Low. Since the transistor N103 becomes in the OFF state as a result, an electric charge is held at the capacitor Ca100 so that the potential of the node PIX is maintained as the inverted potential.

In the period t107, the potential of the data transfer control line DT100 becomes High. This switches the transistor N101 to the ON state, thereby connecting the capacitor Ca100 with the capacitor Cb100 in parallel via the transistor N101. Consequently, the potential of the node MRY becomes Low, caused by the movement of an electric charge between the capacitor Ca100 and the capacitor Cb100. A positive electric charge moves from the capacitor Cb100 to the capacitor Ca100 via the transistor N101, until the potential of the node MRY becomes equal to the potential of the node PIX. This causes an increase in the potential of the node PIX by a slight amount of voltage ΔV2 than that of the period t106, however the potential is within a range of the Low potential.

In the period t108, the potential of the data transfer control line DT100 becomes Low. This switches the transistor N101 into the OFF state, which causes an electric charge to be stored at the capacitor Ca100 so that the potential of the node PIX is maintained as Low, and causes an electric charge to be stored at the capacitor Cb100 so that the potential of the node MRY is maintained Low.

In the period t109, the potential of the refresh output control line RC100 becomes High. This switches the transistor N103 into the ON state, which connects the output terminal OP of the inverter INV100 to the node PIX. The output terminal OP outputs an inverted potential (High in this case) of the potential of the node MRY; the node PIX is charged by this inverted potential. In the period t110, the potential of the refresh output control line RC100 becomes Low. This switches the transistor N103 into the OFF state, and an electric charge is stored at the capacitor Ca100 so that the potential of the node PIX is maintained as the inverted potential.

The refresh period T102 thereafter repeats the period t103 to period t110 until a subsequent write-in period T101 starts. The potential of the node PIX is refreshed to an inverted potential in period t105, and in period t109, the potential of the node PIX is refreshed to the potential of the time when the potential was written in. In a case where a data potential of Low is to be written into the node PIX in the period t101 of the write-in period T101, the potential waveform of the node PIX becomes an inverted waveform of the potential waveform of FIG. 16.

As such, in the memory circuit MR100, the data written in is held while being refreshed, by a data inversion system. In the case where the liquid crystal capacitor Clc is added onto the memory circuit MR100, it is possible to refresh data of black display or data of white display while inverting its polarity, by inverting a potential of the common electrode COM between High and Low, at a timing at which the data is refreshed.

CITATION LIST

Patent Literature

Patent Literature 1

Japanese Patent Application Publication, Tokukai, No. 2002-229532 A (Publication Date: Aug. 16, 2002)

SUMMARY OF INVENTION

Technical Problem

With such a memory liquid crystal display device, many elements (transistor, capacitor, resistance) are required for accomplishing the memory operation mode, in addition to the transistor (transistor N100 of FIG. 15) used in the normal operation mode. Accordingly, the number of various signal lines disposed on one pixel area increases. This is described more specifically with reference to FIG. 17 and FIG. 18. FIG. 17 is a circuit diagram corresponding to FIG. 15. FIG. 18 illustrates a configuration of one pixel corresponding to the circuit diagram of FIG. 17. FIG. 19 is a cross sectional view taken on A-B of FIG. 18. As illustrated in FIG. 18, by having an increased number of signal lines, the wiring pitch becomes densely arranged; this causes an increase in a possibility that the signal lines short-circuit due to dust and the like during the manufacturing stage, thereby decreasing the yield rate. Moreover, since the signal lines disposed in one pixel area is increased in number, an area of one pixel area enlarges, which makes it difficult to narrow a pixel pitch. Furthermore, parts where signal lines intersect (cross) each other increases in number. Hence, this increases a possibility of malfunctions caused by noise. Particularly, a relay line 33 that connects the conductive electrodes of each of the transistors N1, N2, and N4, is disposed in a column direction so as to intersect with a gate line GL(i), a data transfer control line DT(i), a high power line PH(i), and a low power line PL(i), each extending in a direction crossing the pixel (row direction) (see FIG. 19). As a result, the possibility of malfunction caused by noise increases.

In view of the foregoing problem, the present invention proposes a configuration in a memory liquid crystal display device, which allows for improving its yield rate and reducing malfunction caused by noise that is generated between signal lines.

Solution to Problem

In order to attain the object, a liquid crystal display device of the present invention is a memory liquid crystal display device that carries out a refresh operation in a period in which data is held after a data signal potential is written in, the device including: data signal lines; scanning signal lines; storage capacitor lines; data transfer lines; refresh lines; pixel electrodes; a counter electrode; first transistors, each of whose control terminal is connected to a respective one of the scanning signal lines; second transistors, each of whose control terminal is connected to a respective one of the data transfer lines; third transistors, each of whose control terminal is connected to a respective one of the pixel electrodes via a respective one of the second transistors; fourth transistors, each of whose control terminal is connected to a respective one of the refresh lines; first storage capacitors, each of which is connected to a respective one of the pixel electrodes; and second storage capacitors, each of which is connected to a respective one of the pixel electrodes via a respective one of the second transistors, each of the pixel electrodes being connected to a respective one of the data signal lines via a respective one of the first transistors and being connected to a respective one of the data transfer lines via a respective one of the fourth transistors and a respective one of the third transistors, and furthermore, each of the pixel electrodes having at least two contact holes including a first contact hole and a second contact hole, the pixel electrode being connected to one of conductive terminals of the respective first transistor via the first contact hole and being connected to one of conductive terminals of a respective one of the second transistors and one of conductive terminals of the respective fourth transistor via the second contact hole.

According to the configuration, a first transistor, a second transistor, and a fourth transistor are connected by use of two contact holes opened in a pixel electrode. More specifically, a conductive terminal of the first transistor is connected to the pixel electrode via the first contact hole, and a conductive terminal of each of the second transistor and fourth transistor are connected to the pixel electrode via the second contact hole. This allows for omitting a conventionally used relay line (relay line 33 in FIG. 18, disposed between the contact holes 12 and 16) that extends in a column direction and intersects with a scanning signal line, a data transfer line, and a refresh line, each of which extends in the row direction. Consequently, it is possible to reduce short-circuiting of signal lines and malfunctions caused by noise generated between the signal lines, as compared to the conventional configuration (see FIG. 18). Furthermore, it is possible to improve the yield rate.

Moreover, in order to attain the object, a liquid crystal display device of the present invention is a memory liquid crystal display device that carries out a refresh operation in a period in which data is held after a data signal potential is written in, the device including: data signal lines; scanning signal lines; storage capacitor lines; data transfer lines; refresh lines; high potential power lines; low potential power lines; pixel electrodes; a counter electrode; N-channel first transistors, each of whose control terminal is connected to a respective one of the scanning signal lines; N-channel second transistors, each of whose control terminal is connected to a respective one of the data transfer lines; N-channel third transistors and P-channel fifth transistors, each of whose control terminals are connected to a respective one of the pixel electrodes via a respective one of the second transistors and whose one of conductive terminals are connected to each other; fourth transistors, each of whose control terminal is connected to a respective one of the refresh lines and whose one of conductive terminals is connected to the one of conductive terminals of a respective one of the third transistors and that of a respective one of the fifth transistors; first storage capacitors, each of which is connected to a respective one of the pixel electrodes; and second storage capacitors, each of which is connected to a respective one of the pixel electrodes via a respective one of the second transistors, the other one of the conductive terminals of the third transistors being connected to a respective one of the low potential power lines, and the other one of the conductive terminals of the fifth transistors being connected to a respective one of the high potential power lines, each of the pixel electrodes being connected to (i) a respective one of the data signal lines via a respective one of the first transistors, (ii) a respective one of the high potential power lines via a respective one of the fourth transistors and a respective one of the fifth transistors, and (iii) a respective one of the low potential power lines via the respective fourth transistor and a respective one of the third transistors, and furthermore, each of the pixel electrodes having at least two contact holes including a first contact hole and a second contact hole, the pixel electrode being connected to one of conductive terminals of the respective first transistor via the first contact hole, and the pixel electrode being connected to one of conductive terminals of a respective one of the second transistors and one of conductive terminals of the respective fourth transistor, via the second contact hole.

Advantageous Effects of Invention

As described above, the liquid crystal display device of the present invention is configured in such a manner that the pixel electrode has at least two contact holes including a first contact hole and a second contact hole, and that the pixel electrode is connected to one of conductive terminals of the first transistor via the first contact hole and is connected to one of conductive terminals of the second transistor and one of conductive terminals of the fourth transistor, via the second contact hole.

This allows for reducing short-circuiting of signal lines and malfunctions caused by noise generated between the signal lines, and for improving its yield rate, as compared to a conventional configuration.

DESCRIPTION OF EMBODIMENTS

Figure 1:
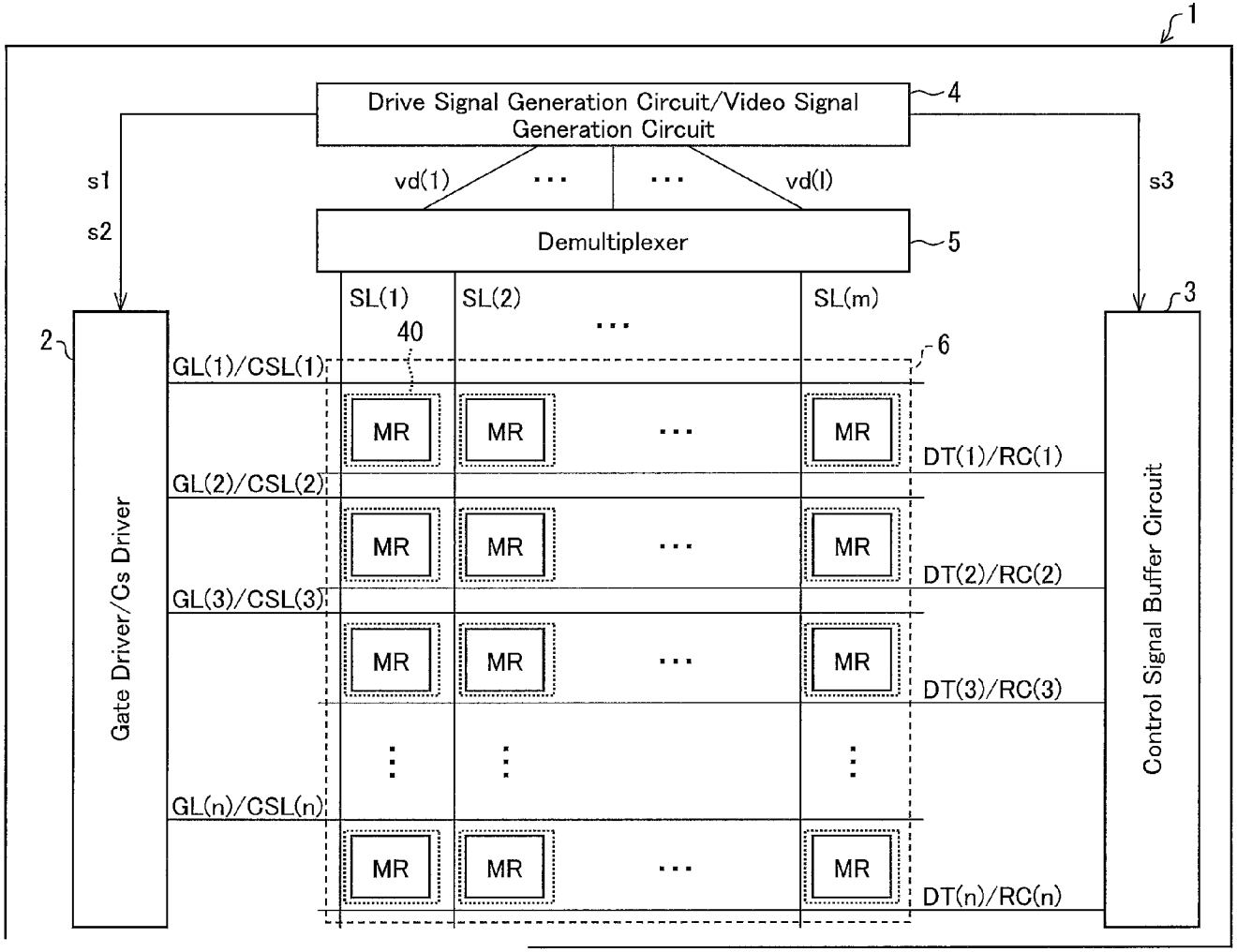
FIG. 1 is a block diagram illustrating a configuration of a liquid crystal display device according to the present embodiment.

One embodiment of the present invention is described below with reference to drawings. FIG. 1 illustrates a configuration of a liquid crystal display device according to the present embodiment. The present liquid crystal display device 1 is a memory liquid crystal display device including a liquid crystal panel provided with a memory circuit (pixel memory MR), which device performs a refreshing operation during a data holding period that follows a write-in of a data signal potential. The liquid crystal display device 1 operates by switching over between (a) a multicolor (multiple tone) display mode (normal operation mode) used in screen display or the like while a portable phone is being operated and (b) a memory operation mode used in screen display or the like while the portable phone is in standby.

The liquid crystal display device 1 includes a gate driver/CS driver 2 (scanning signal line drive circuit/storage capacitor line drive circuit), a control signal buffer circuit 3, a drive signal generation circuit/video signal generation circuit 4 (display control circuit), a demultiplexer 5, and a pixel array 6. The liquid crystal display device 1 further includes gate lines (scanning signal lines) GL(i), CS lines (storage capacitor lines) CSL(i), data transfer control lines (data transfer lines) DT(i), refresh output control lines (refresh lines) RC(i), source lines (data signal lines) SL(j), and output signal lines vd(k). Note that "i" is an integer in a range of $1 \leq i \leq n$, "j" is an integer of $1 \leq j \leq m$, and "k" is an integer of $1 \leq k \leq 1 < m$.

The pixel array 6 is configured in such a manner that pixels 40 each having a pixel memory MR (memory circuit) are disposed in a matrix of n rows and m columns. Each of the pixel memories MR independently holds image data. The gate lines GL(i), the data transfer control lines DT(i), the refresh output control lines RC(i), the CS lines CSL(i), and the source lines SL(j) are arranged so as to be associated with corresponding pixel memories MR each located at an intersection of a row i and a column j.

The gate driver/CS driver 2 is a drive circuit which drives the pixels 40 for the n number of rows, through the gate lines GL(i) and the CS lines CSLi. The gate lines GL(i) and the CS lines CSL(i) are connected to the corresponding pixels 40 in the ith row.

The control signal buffer circuit 3 is a drive circuit which drives the pixels 40 in the n rows, through the data transfer control lines DT(i) and the refresh output control lines RC(i).

The drive signal generation circuit/video signal generation circuit 4 is a control drive circuit for carrying out image display and memory operation, and may also serve as a circuit not just for generating a timing for use in the memory operation but also as a circuit for generating timing of a gate start pulse, a gate clock, a source start pulse, a source clock and the like which are used in the display operations.

During the multicolor display mode (while the memory circuit is not operating), the drive signal generation circuit/video signal generation circuit 4 outputs a multiple tone video signal from a video output terminal, and drives the source line SL(j) through the output signal line vd(k) and the demultiplexer 5. Moreover, the drive signal generation circuit/video signal generation circuit 4 simultaneously outputs a signal s1 which drives and controls the gate driver/CS driver 2. This allows for writing in the display data to the pixels 40 and displaying a multiple tone.

Moreover, during the memory circuit operation mode, the drive signal generation circuit/video signal generation circuit 4(*i*) sends out the data to be held in the pixels 40 from the video output terminal to the source line SL(j) through the output signal line vd(k) (k is an integer of $1 \leq k \leq 1 < m$) and the demultiplexer 5, (ii) outputs a signal s2 which drives and controls the gate driver/CS driver 2, and (iii) outputs a signal s3 which drives and controls the control signal buffer circuit 3. This allows for writing in data to display and hold the data in the pixels 40 and for reading out the data held in the pixels 40.

The data written into the pixels 40 and held in the memory circuit may just be used for display, and thus a read-out operation from the pixels 40 does not necessarily need to be carried out. The data outputted from the video output terminal to the output signal lines vd(k) in the drive signal generation circuit/video signal generation circuit 4 during the memory circuit operation mode is of a binary logic level given by a first potential level and a second potential level. If the pixels 40 correspond to the pixels of the color display, display is possible with the number of colors calculated by exponentiating two (2) by the number of colors of the pixel. For instance, if the pixel has three colors of RGB, display is possible in a display mode of eight colors (two by the power of three).

The demultiplexer 5 sorts data outputted to the output signal lines vd(k) to its corresponding source lines SL(j), and outputs the data.

Figure 2:
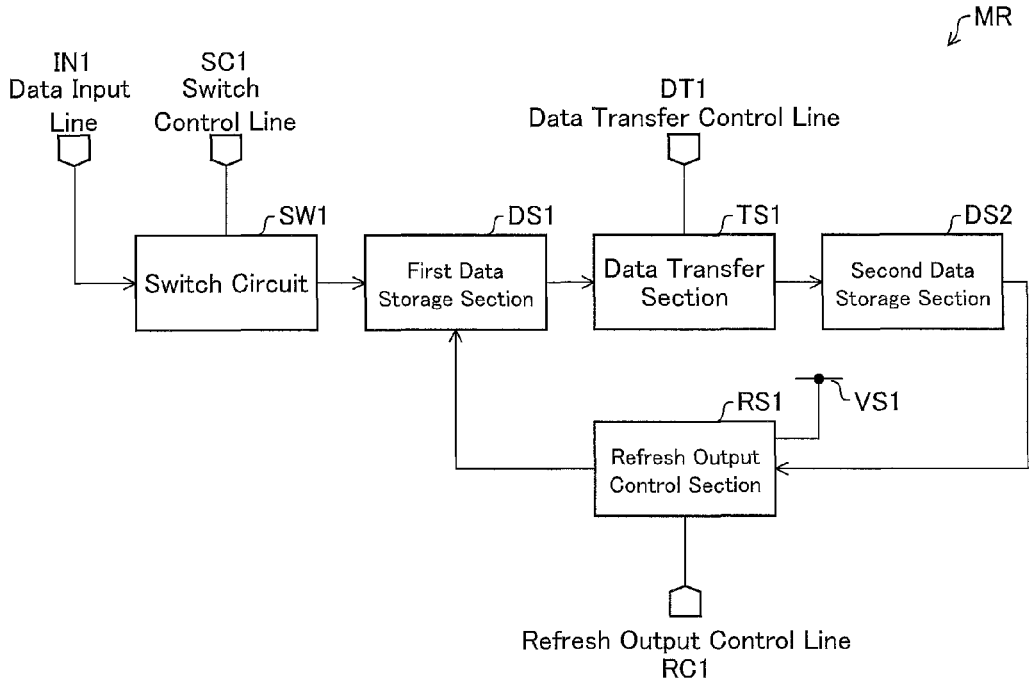
FIG. 2 is a block diagram illustrating a configuration of a pixel memory in the present liquid crystal display device.

FIG. 2 illustrates a concept of the configuration of the pixel memories MR.

The pixel memory MR includes a switch circuit SW1, a first data storage section DS1, a data transfer section TS1, a second data storage section DS2, a refresh output control section RS1, and a supply source VS1.

Moreover, the pixel memory MR includes a data input line IN1 corresponding to the source line SL(1), a switch control line SC1 corresponding to the gate line GL(1), a data transfer control line DT1, and a refresh output control line RC1.

The switch circuit SW1 selectively switches between a state in which the data input line IN1 and the first data storage section DS1 are electrically connected to each other and a state in which the data input line IN1 and the first data storage section DS1 are electrically disconnected to each other, by the switch circuit SW1 being driven by the gate driver/CS driver 2 through the switch control line SC1.

The first data storage section DS1 stores a binary logic level that is inputted into the first data storage section DS1.

The data transfer section DT1 selectively carries out (i) a transfer operation, which transfers the binary logic level stored in the first data storage section DS1 to the second data storage section DS2 in such a manner that the first data storage section DS1 still stores the binary logic level, by the data transfer section DT1 being driven by the control signal buffer circuit 3 through the data transfer control line DT1, or (ii) a non-transfer operation in which no transfer operation is carried out. The signal supplied to the data transfer control line DT1 is common for all pixel memories MR; the data transfer control line DT1 is not necessarily provided on each row and driven by the control signal buffer circuit 3, and may be driven by the drive signal generation circuit/video signal generation circuit 4 or by another member.

The second data storage section DS2 stores a binary logic level inputted into the second data storage section DS2.

The refresh output control section RS1 is selectively controlled in a state for carrying out a first operation or a state for carrying out a second operation, by being driven by the control signal buffer circuit 3 through the refresh output control line RC1. The signal supplied to the refresh output control line RC1 is common for all the pixel memories MR; the refresh output control line RC1 is not necessarily provided on each row and driven by the control signal buffer circuit 3, and may be driven by the drive signal generation circuit/video signal generation circuit 4 or another member.

The first operation is an operation of selecting either of an active state or an inactive state depending on control information of whether the binary logic level stored in the second data storage section DS2 is of the first potential level or of the second potential level; the active state is a state in which an input to the refresh output control section RS1 is taken in and supplied to the first data storage section DS1 as an output of the refresh output control section RS1, and the inactive state is a state in which outputting of the refresh output control section RS1 is stopped.

The second operation is an operation of stopping the outputting of the refresh output control section RS1, regardless of the control information.

The supply source VS1 supplies a set potential to the input of the refresh output control section RS1.

Figure 3:
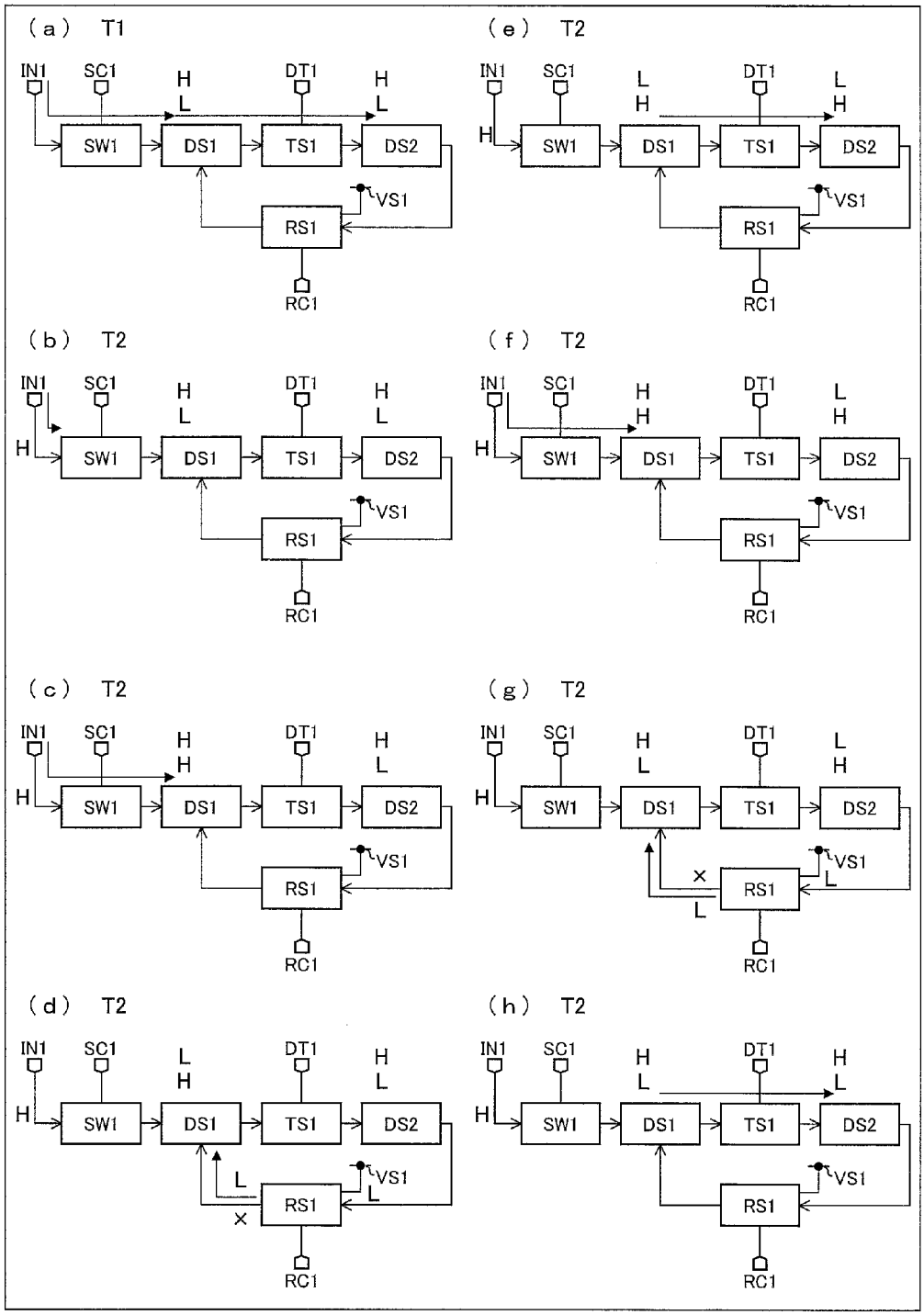
FIG. 3 is a view illustrating operations of the pixel memory of FIG. 2, and (a) through (h) thereof illustrate each of the operations.

The following describes a transition of states of the pixel memory MR, with reference to (a) through (h) of FIG. 3. In the embodiment, the first potential level is High and is shown as "H" in the drawing, and the second potential level is Low and is shown as "L" in the drawing. Moreover, at parts where "H" and "L" are written in a line on top of each other, the upper one indicates the transition state of the potential level in a case where "H" is to be written into the pixel memory MR, and the lower one indicates a transition state of the potential level in a case where "L" is to be written into the pixel memory MR.

In a write-in mode of data, first, a write-in period T1 of data is provided.

As illustrated in (a) of FIG. 3, the write-in period T1 has the switch circuit SW1 in the ON state by the switch circuit SW1 being effected by the switch control line SC1, and has a binary logic level, expressed by either the first potential level or the second potential level corresponding to the data, be inputted into the first data storage section DS1 from the data input line IN1 via the switch circuit SW1.

After the binary logic level is inputted into the first data storage section DS1, the switch circuit SW1 switches to the OFF state by the switch circuit SW1 being effected by the switch control line SC1. Moreover, at this time, the data transfer section TS1 is made in the ON state by being effected by the data transfer control line DT1, which ON state allows for the transfer operation. The binary logic level is transferred to the second data storage section DS2 from the first data storage section DS1 via the data transfer section TS1 while the binary logic level inputted into the first data storage section DS1 is kept stored in the first data storage section DS1. After the binary logic level is transferred to the second data storage section DS2, the data transfer section TS1 switches to the OFF state, that is, a state in which no transfer operation is carried out.

Moreover, subsequent to the write-in period T1, a refresh period T2 (data holding period) is provided.

As illustrated in (b) of FIG. 3, the refresh period T2 first outputs the first potential level from the demultiplexer 15 to the data input line IN1.

Thereafter, as illustrated in (c) of FIG. 3, the switch circuit SW1 is switched to the ON state by being effected by the switch control line SC1, and the first potential level is inputted from the data input line IN1 to the first data storage section DS1 via the switch circuit SW1. After the first potential level is inputted into the first data storage section DS1, the switch circuit SW1 switches to the OFF state by being effected by the switch control line SC1.

Next, as illustrated in (d) of FIG. 3, the refresh output control section RS1 is controlled by the refresh output control line RC1 to be in a state in which the first operation is carried out. The first operation of the refresh output control section RS1 differs depending on control information, which information is indicative of whether the second data storage section DS2 stores the first potential level or the second potential level as the binary logic level.

Namely, in a case in which the second data storage section DS2 stores the first potential level, the refresh output control section RS1 is made into the active state by having first control information be transmitted from the second data storage section DS2 to the refresh output control section RS1, which first control information indicates that the second data storage section DS2 stores the first potential level, and thereafter the refresh output control section RS1 takes in an input into the refresh output control section RS1 and supplies this to the first data storage section DS1 as an output of the refresh output control section RS1. When the refresh output control section RS1 carries out the first operation, the potential of the supply source VS1 is set so that it is possible to supply the second potential level to the input of the refresh output control section RS1 at least finally, during a period in which the first control information is transmitted to the refresh output control section RS1. In this case, the first data storage section DS1 stores the second potential level supplied from the refresh output control section RS1 in such a manner that the second potential level is written over the binary logic level stored until then.

On the other hand, in the case where the second potential level is stored in the second data storage section DS2, the refresh output control section RS1 is in the inactive state; by having second control information be transmitted from the second data storage section DS2 to the refresh output control section RS1, which second control information indicates that the second data storage section DS2 stores the second potential level, the state becomes a state in which output is stopped (shown as "×" in drawing). In this case, the first data storage section DS1 continues to store the first potential level.

Thereafter, the refresh output control section RS1 is controlled to be in a state in which the second operation is carried out, by being effected by the refresh output control line RC1.

Next, as illustrated in (e) of FIG. 3, in the refresh period T2, the data transfer section TS1 is next made into a state for carrying out transfer operation by being effected by the data transfer control line DT1; the binary logic data stored in the first data storage section DS1 is transferred to the second data storage section DS2 from the first data storage section DS1 via the data transfer section TS1, while the binary logic data is kept stored in the first data storage section DS1. After the data is transferred from the first data storage section DS1 to the second data storage section DS2, the data transfer section TS1 is made into the OFF state, that is, made in a state in which no transfer operation is carried out.

Next, as illustrated in (f) of FIG. 3, the switch circuit SW1 is made into the ON state by the switch control line SC1, and the first potential level is inputted into the first data storage section DS1 from the data input line IN1 via the switch circuit SW1. After the first potential level is inputted into the first data storage section DS1, the switch circuit SW1 is switched to the OFF state by being effected by the switch control line SC1.

Next, as illustrated in (g) of FIG. 3, the refresh output control section RS1 is controlled to a state which carries out the first operation, by being effected by the refresh output control line RC 1. In the case where the first potential level is stored in the second data storage section DS2, the refresh output control section RS1 becomes in an active state, and carries out an operation of supplying a second potential level that is supplied from the supply source VS1 to the first data storage section DS1. In this case, the first data storage section DS1 stores the second potential level supplied from the refresh output control section RS1 in a state in which the second potential level is written over the binary logic level stored until then. On the other hand, in a case where the second potential level is stored in the second data storage section DS, the refresh output control section RS1 is in the inactive state, and becomes a state in which the output is stopped. In this case, the first data storage section DS1 continues to store the first potential level stored until then. Thereafter, the refresh output control section RS1 is controlled to be in a state for carrying out the second operation by being controlled by the refresh output control line RC1, and is made in the state in which no output is made.

Subsequently, as illustrated in (h) of FIG. 3, the data transfer section TS1 is made into a state in which a transfer operation is carried out by the data transfer control line DT1, and the binary logic level stored in the first data storage section DS1 until then is transferred to the second data storage section DS2 from the first data storage section DS1 via the data transfer section TS1, while the binary logic level is still kept stored in the first data storage section DS1. After the binary logic level is transferred from the first data storage section DS1 to the second data storage section DS2, the data transfer section TS1 becomes in the OFF state, i.e. in the non-transfer operation state.

By the foregoing series of operations, the binary logic level written into the write-in period T1 in (a) of FIG. 3 is reconstituted in the first data storage section DS1 and the second data storage section DS2, in (h) of FIG. 3. Hence, even if the operations from (b) through (h) of FIG. 3 are repeated any number of times after (h) of FIG. 3, the data written into the write-in period T1 is similarly reconstituted.

Here, in a case where the first potential level (High in this case) is written into the write-in period T1, the first potential level is reconstituted to the first potential level by being inverted in level once each in (d) of FIG. 3 and (f) of FIG. 3 and thereafter being refreshed; in a case where the second potential level (Low in this case) is written into the write-in period T1, the second potential level is reconstituted to the second potential level by being inverted once each in (c) of FIG. 3 and (g) of FIG. 3 and thereafter being refreshed.

If the first potential level is to be Low and the second potential level is to be High, the foregoing operation principle is to be reversed.

According to the configuration, in the refresh period T2, the first potential level is supplied from the data input line IN1 to the first data storage section DS1 as illustrated in (c) and (f) of FIG. 3, and the refresh output control section RS1 makes the second potential level be supplied from the supply source VS1 to the first data storage section DS1, as in (d) and (g) of FIG. 3. Hence, there is no need to have an inverter for carrying out the refresh operation.

As such, according to the liquid crystal display device 1, it is possible to refresh a binary logic level corresponding to the binary logic data written into a pixel memory MR while inverting the level of the binary logic data, by (i) writing in the binary logic data to the first data storage section DS1, (ii) supplying to the pixel memories MR, without use of an inverter, one of a first potential level and a second potential level from the data input line IN1 and supplying the other one of the first potential level and the second potential level from the supply source VS1.

Next describes a specific configuration and operation of the pixel memory MR.

Figure 4:
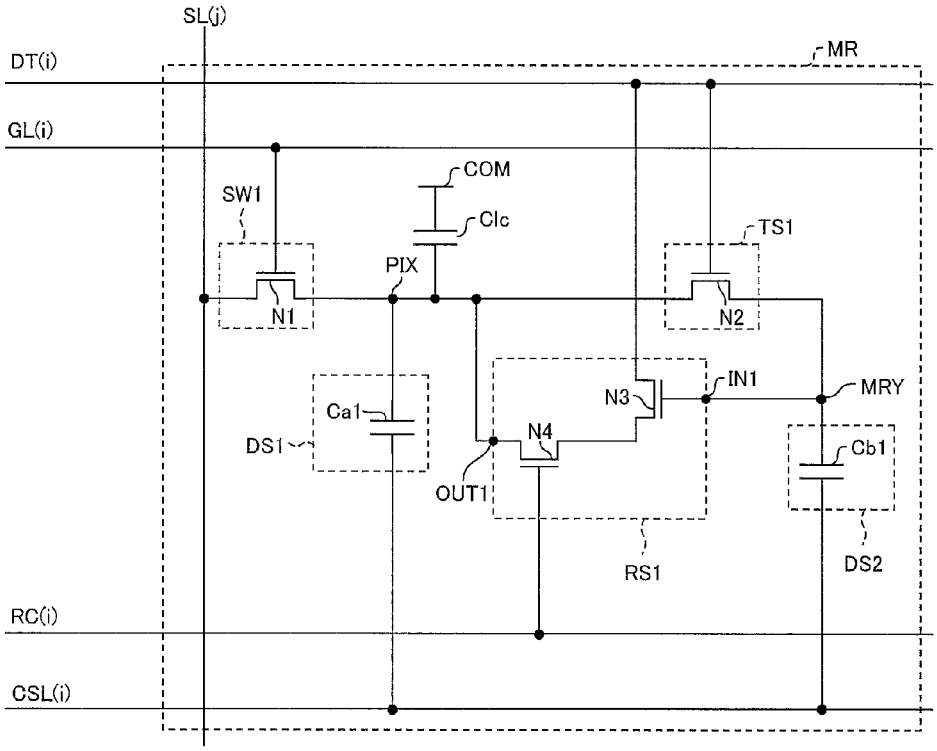
FIG. 4 is a circuit diagram illustrating a configuration of a pixel memory in the present liquid crystal display device.

FIG. 4 illustrates a configuration of the pixel memory MR (memory circuit) according to the present embodiment, as an equivalent circuit.

The pixel memory MR includes, as described above, a switch circuit SW1, a first data storage section DS1, a data transfer section TS1, a second data storage section DS2, and a refresh output control section RS1.

The switch circuit SW1 includes a transistor N1 (first transistor) which is an N-channel TFT. The first data storage section DS1 includes a capacitor Ca1 (first storage capacitor). The data transfer section TS1 includes a transistor N2 (second transistor), which is an N-channel TFT serving as a transfer element. The second data storage section DS2 includes a capacitor Cb1 (second storage capacitor). The refresh output control section RS1 includes a transistor N3 (fourth transistor), which is an N-channel TFT, and a transistor N4 (third transistor), which is an N-channel TFT. The capacitor Ca1 has a capacitance greater than that of the capacitor Cb1.

Namely, in FIG. 4, all transistors that make up the pixel memory MR are N-channel TFTs (field effect transistor). Hence, the pixel memory MR can be made easily inside amorphous silicon.

Moreover, as signal lines for driving the pixel memories MR, the liquid crystal display device 1 includes the gate lines GL(i), the data transfer control lines DT(i), the refresh output control lines RC(i), the source lines SL(j), and the CS lines CSL(i).

One of drain/source terminals (conductive terminal) of a field-effect transistor as like the TFT is called a first drain/source terminal, and the other one of the drain/source terminals is called a second drain/source terminal. The same applies for other examples herein.

A gate terminal (control terminal) of the transistor N1 is connected to a corresponding one of the gate lines GL(i), a first drain/source terminal of the transistor N1 is connected to a corresponding one of the source lines SL(j), and a second drain/source terminal of the transistor N1 is connected to a node PIX (storage node) which is one end of the capacitor Ca1. The other end of the capacitor Ca1 is connected to a corresponding one of the CS lines CSL (i). When the transistor N1 is in the ON state, the switch circuit SW1 is in a conductive state, and when the transistor N1 is in the OFF state, the switch circuit SW1 is in a disconnected state.

A gate terminal of the transistor N2 is connected to a corresponding one of the data transfer control line DT(i), a first drain/source terminal of the transistor N2 is connected to the node PIX, and a second drain/source terminal of the transistor N2 is connected to a node MRY (storage node) which is one end of the capacitor Cb1. The other end of the capacitor Cb1 is connected to the CS line CSL(i). When the transistor N2 is in the ON state, the data transfer section TS1 is in a state in which the transfer operation is carried out, and when the transistor N2 is in the OFF state, the data transfer section TS1 is in a state in which no transfer operation is carried out.

A gate terminal of the transistor N3 is connected to the node MRY as an input terminal IN1 of the refresh output control section RS1, a first drain/source terminal of the transistor N3 is connected to the data transfer control line DT(i), and a second drain/source terminal of the transistor N3 is connected to a first drain/source terminal of the transistor N4. A gate terminal of the transistor N4 is connected to the refresh output control line RC(i), and the second drain/source terminal of the transistor N4 is connected to the node PIX as an output terminal OUT1 of the refresh output control section RS1. Namely, the transistor N3 and the transistor N4 are connected in series, disposed between the input of the refresh output control section RS1 and the output of the refresh output control section RS1 in such a manner that the transistor N3 is disposed on a side closer to the input of the refresh output control section RS1. The connected position of the transistor N3 and the transistor N4 may be the other way round of the example above, as long as the transistor N3 and the transistor N4 are connected in series between the input of the refresh output control section RS1 and the output of the refresh output control section RS1.

When the transistor N4 is in the ON state, the refresh output control section RS1 is controlled in a state in which the first operation is carried out, and when the transistor N4 is in the OFF state, the refresh output control section RS1 is controlled in a state in which a second operation is carried out. The transistor N3 is of an N-channel; when the refresh output control section RS1 carries out the first operation, the control information in the active state, i.e. the active level, is High, and the control information in an inactive state, i.e. the inactive level, is Low.

Note that a liquid crystal capacitor Clc is connected between the node PIX and the counter electrode (common electrode) COM.

The next description explains the operation of the pixel memory MR of the foregoing configuration.

Figure 5:
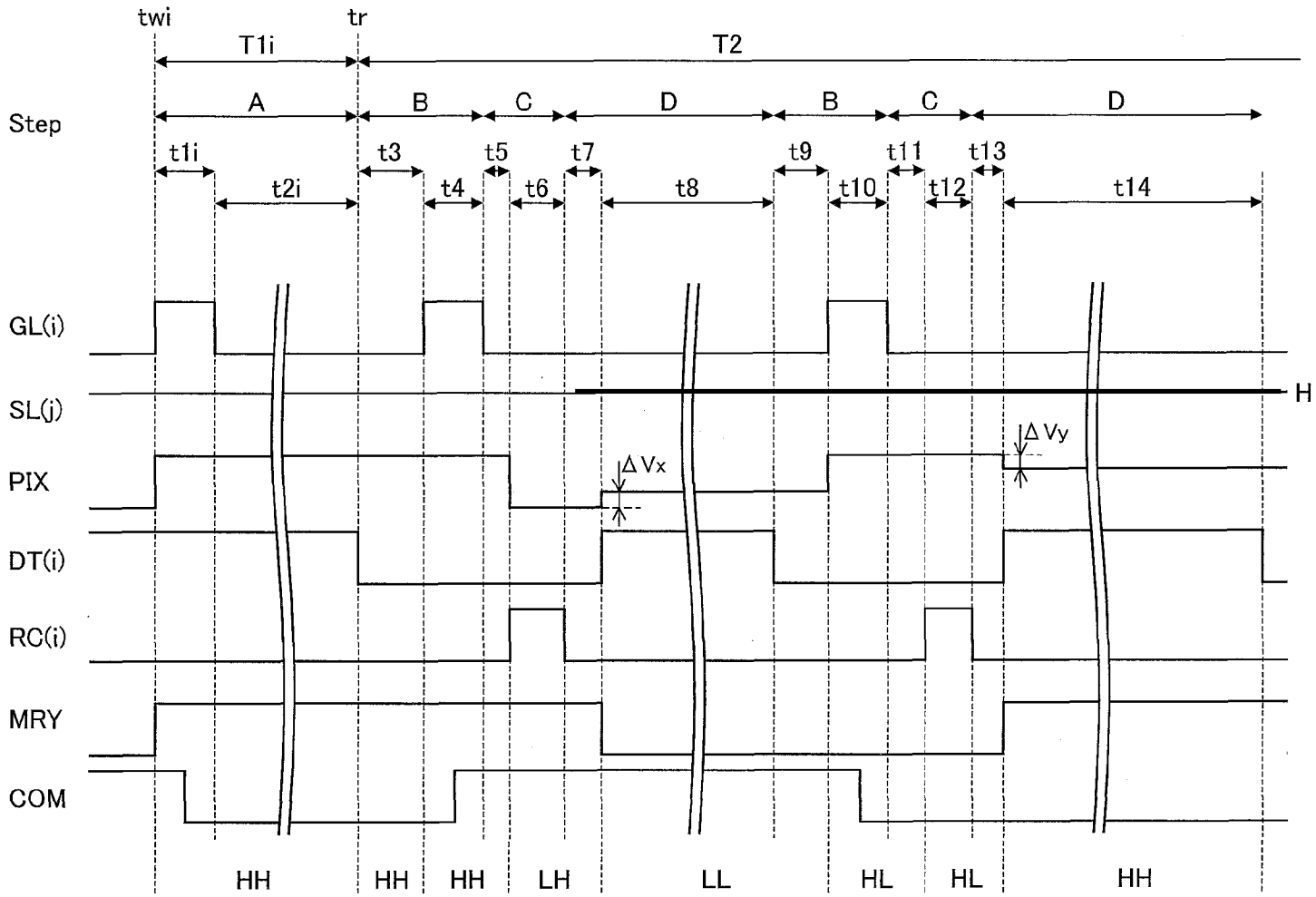
FIG. 5 is a timing chart illustrating an operation of the pixel memory of FIG. 4.
Figure 6:
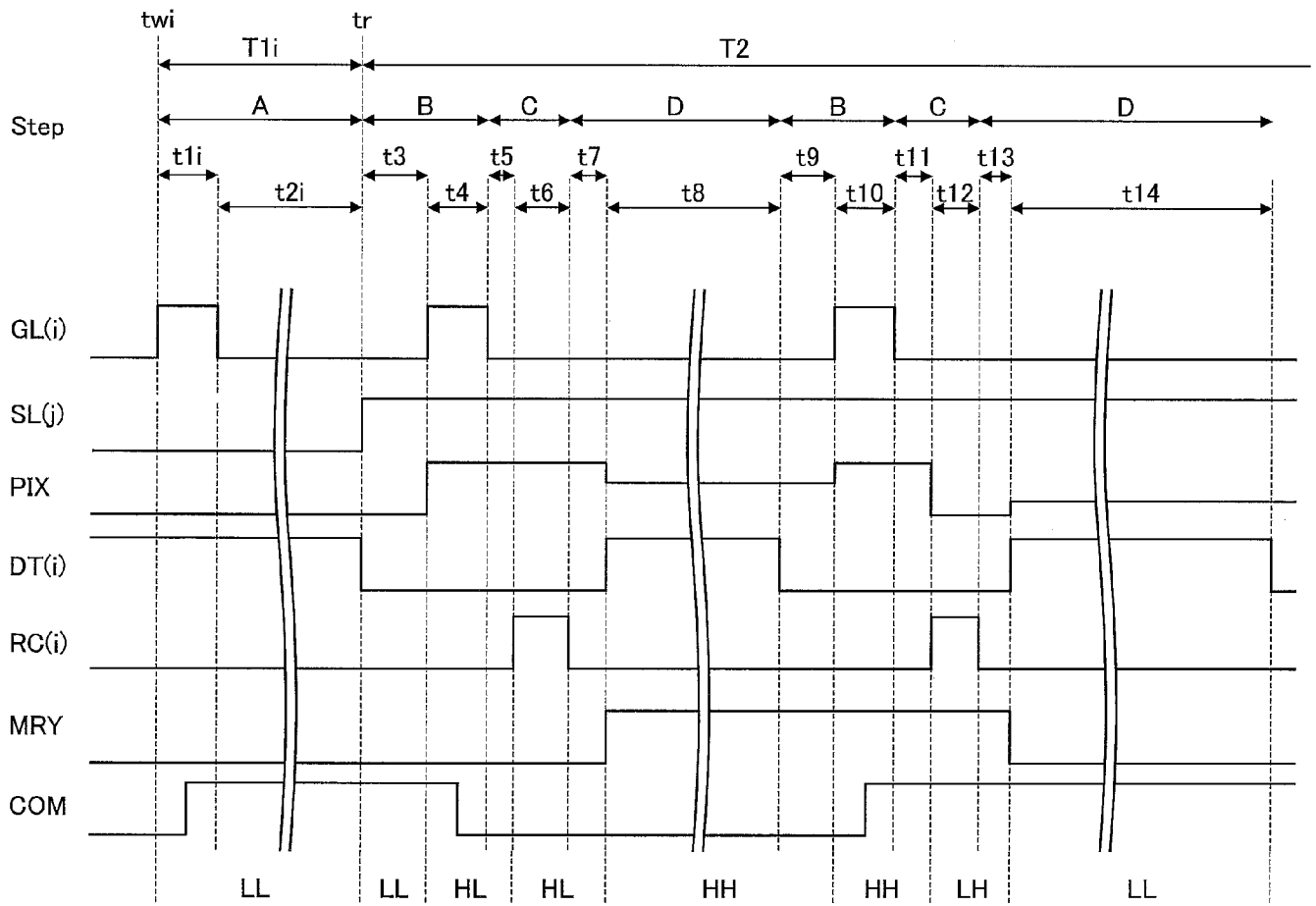
FIG. 6 is a timing chart illustrating another operation of the pixel memory of FIG. 4.

FIG. 5 and FIG. 6 each illustrate a write-in operation of data into the pixel memory MR. In the present example, rows of the pixel array 6 are driven (scanned) line sequentially. Hence, the write-in period T1 is determined per row, and the write-in period T1 of row i is expressed as T1*i*. FIG. 5 illustrates a case in which "1"=High is written into the write-in period T1*i* as first data, and FIG. 6 illustrates a case in which "0"=Low is written into the write-in period T1*i* as second data. Moreover, FIG. 5 and FIG. 6 each provides, on their lower parts, the potential of the node PIX (left) and the potential of the node MRY (right) for each period corresponding to (a) through (h) of FIG. 3.

In FIG. 5, potentials of binary levels of High (active level) and Low (inactive level) are applied on the gate line GL(i), the data transfer control line DT(i), and the refresh output control line RC(i) from the control signal buffer circuit 13. Alternatively, a High potential and a Low potential of the binary level may be set individually for each line. To the source line SL(j), a binary logic level of High and Low having a lower High potential than the High potential of the gate line GL(i) is outputted from the drive signal generation circuit/video signal generation circuit 14 via the demultiplexer 5. The High potential of the data transfer control line DT(i) is equal to either of the High potential of the source line SL(j) or the High potential of the gate line GL(i), and the Low potential of the data transfer control line DT(i) is equal to the Low potential of the binary logic level. Moreover, a potential (CS potential) supplied by the CS line CSL(i) is fixed.

The write-in operation of data has a write-in period T1*i* and a refresh period T2. The write-in period T1*i* starts from a time twi set per row. The refresh period T2 is started at once for all rows from time tr after the writing in of data is completed for all rows of the pixel memories MR. The write-in period T1*i* is a period to write in data to be held by the pixel memory MR1, and is made up of a period t1*i* and a period t2*i* sequentially provided. The refresh period T2 is a period which holds the data written into the pixel memory MR while refreshing the data, and includes period t3 to period t14 sequentially provided.

In the write-in period T1*i*, potentials of both the gate line GL(i) and the data transfer control line DT(i) are High in the period t1*i*. The potential of the refresh output control line RC(i) is Low. This causes the transistors N1 and N2 to be in an ON state, which makes the switch circuit SW1 be in a conductive state and the data transfer section TS1 be in a state in which a transfer operation is carried out. Furthermore, a first potential level (High in this case) supplied to the source line SL(j) is written into the node PIX. In the period t2*i*, the potential of the gate line GL(i) becomes Low, whereas the potential of the data transfer control line DT(i) is maintained High. The potential of the refresh output control line RC(i) is Low. This makes the transistor N1 be in the OFF state, which causes the switch circuit SW1 to be in the disconnected state. Moreover, since the transistor N2 maintains its ON state, the data transfer section TS1 maintains its state of carrying out the transfer operation. Therefore, a first potential level is transferred from the node PIX to the node MRY, and the nodes PIX and MRY are disconnected from the source line SL(j). The foregoing process corresponds to the state in (a) of FIG. 3.

Subsequently, the refresh period T2 starts. In the refresh period T2, the potential of the source line SL(j) is High, which is the first potential level. Moreover, with the gate line GL(i), the data transfer control line DT(i), and the refresh output control line RCi, a drive described below is carried out for all those lines which fall under the following range: $1 \leq i \leq n$. Namely, a refresh operation is carried out at once to all of the pixel memories MR (hereinafter, may be referred to as "entire refresh operation").

In the refresh period T2, the potential of the gate line GL(i) becomes Low, the potential of the data transfer control line DT(i) is Low, and the potential of the refresh output control line RC(i)i is Low in the period t3. This causes the transistor N2 to be in the OFF state, which makes the data transfer section TS1 be in a state in which no transfer operation is carried out, thereby making the node PIX and the node MRY be disconnected from each other. Both of the node PIX and the node MRY are maintained High. The foregoing process corresponds to the state of (b) in FIG. 3.

In the period t4, the potential of the gate line GL(i) becomes High, the potential of the data transfer control line DT(i) is maintained Low, and the potential of the refresh output control line RC(i) is maintained Low. This makes the transistor N1 be in the ON state, which makes the switch circuit SW1 be in a conductive state, and a High potential is again written into the node PIX from the source line SL(j).

In the period t5, the potential of the gate line GL(i) becomes Low, the potential of the data transfer control line DT(i) is maintained Low, and the potential of the refresh output control line RC(i) is maintained Low. The transistor N1 is thus in the OFF state, which causes the switch circuit SW1 to be in the disconnected state, and the node PIX is disconnected from the source line SL(j) and is maintained High.

The processes of period t4 and period t5 correspond to the state in FIG. 5(*c*).

In the period t6, the potential of the gate line GL(i) is maintained Low, the potential of the data transfer control line DT(i) is maintained Low, and the potential of the refresh output control line RC(i) becomes High. This makes the transistor N4 be in the ON state, and the refresh output control section RS1 carries out the first operation. Moreover, since the potential of the node MRY is High, the transistor N3 is in the ON state; this causes the refresh output control section RS1 to be in an active state, and a Low potential is supplied from the data transfer control line DT(i) to the node PIX, via the transistors N3 and N4. The data transfer control line DT(i) also serves as the supply source VS1 in FIG. 2.

In the period t7, the potential of the gate line GL(i) is maintained Low, the potential of the data transfer control line DT(i) is maintained Low, and the potential of the refresh output control line RC(i) becomes Low. This makes the transistor N4 be in the OFF state, which causes the refresh output control section RS1 to be in a state which carries out a second operation, and the node PIX is disconnected from a second word line Xi(2) and is maintained Low.

The process of period t6 to period t7 corresponds to the state in (d) of FIG. 3.

In the period t8, the potential of the gate line GL(i) is maintained Low, the potential of the data transfer control line DT(i) becomes High, and the potential of the refresh output control line RC(i) is maintained Low. This makes the transistor N2 be in the ON state, and the data transfer section TS1 becomes in the state in which the transfer operation is carried out. At this time, electric charge moves between the capacitor Ca1 and the capacitor Cb1, and the potential of both the node PIX and the node MRY become Low. The potential of the node PIX increases just by a slight voltage ΔVx caused by a positive electric charge moving from the capacitor Cb1 to the capacitor Ca1 via the transistor N2, however this increase is within a range of the Low potential.

The period t8 is a period in which refreshed binary logic data is stored by both the first data storage section DS1 and the second data storage section DS2 that are connected to each other via the data transfer section TS1, and this period t8 may be set long. The same applies for the examples described later.

In the period t9, the potential of the gate line GL(i) is maintained Low, the potential of the data transfer control line DT(i) becomes Low, and the potential of the refresh output control line RC(i) is maintained Low. This makes the transistor N2 be in the OFF state, which causes the data transfer section TS1 to be in a state in which no transfer operation is carried out, and the node PIX and the node MRY are disconnected from each other. The node PIX and the node MRY are both maintained Low. The process of period t8 to period t9 corresponds to the state of (e) of FIG. 3.

In the period t10, the potential of the gate line GL(i) becomes High, the potential of the data transfer control line DT(i) is maintained Low, and the potential of the refresh output control line RC(i) is maintained Low. This makes the transistor N1 be in the ON state, whereby causing the switch circuit SW1 to be in a conductive state, and as a result, a High potential is again written into the node PIX from the source line SL(j).

In the period t11, the potential of the gate line GL(i) becomes Low, the potential of the data transfer control line DT(i) is maintained Low, and the potential of the refresh output control line RC(i) is maintained Low. This makes the transistor N1 be in the OFF state, which causes the switch circuit SW1 to be in the disconnected state. Consequently, the node PIX maintains its High state by being disconnected from the source line SL(j).

The process of period t10 to period t11 corresponds to the state of (f) of FIG. 3.

In period t12, the potential of the gate line GL(i) is maintained Low, the potential of the data transfer control line DT(i) is maintained Low, and the potential of the refresh output control line RC(i) becomes High. This makes the transistor N4 be in the ON state, and the refresh output control section RS1 becomes in a state in which the first operation is carried out. Moreover, since the potential of the node MRY is Low, the transistor N3 is in the OFF state; this makes the refresh output control section RS1 be in the inactive state, which is a state in which output is stopped. As a result, the node PIX maintains its High state.

In the period t13, the potential of the gate line GL(i) is maintained Low, the potential of the data transfer control line DT(i) is maintained Low, and the potential of the refresh output control line RC(i) becomes Low. This makes the transistor N4 be in the OFF state, which causes the refresh output control section RS1 to become in a state in which the second operation is carried out, and the node PIX is maintained as High.

The process of period t12 to period t13 corresponds to the state of (g) of FIG. 3.

In the period t14, the potential of the gate line GL(i) is maintained Low, the potential of the data transfer control line DT(i) is maintained High, and the potential of the refresh output control section RS1 is maintained Low. This makes the transistor N2 be in the ON state, which causes the data transfer section TS1 to be in the state in which the transfer operation is carried out. At this time, an electric charge moves between the capacitor Ca1 and the capacitor Cb1, thereby causing the potentials of both the node PIX and the node MRY to become High. Although the potential of the node PIX decreases just by a slight voltage ΔVy due to the movement of a positive electric charge from the capacitor Ca1 to the capacitor Cb1 via the transistor N2, the decreased potential is still within a range of the High potential. The foregoing process corresponds to the state in (h) of FIG. 3.

The period t14 is a period in which refreshed binary logic data is stored by both the first data storage section DS1 and the second data storage section DS2 that are connected to each other via the data transfer section TS1, and this period can be set long. The same applies for Examples described later.

As a result of the foregoing operations, the node PIX is High from the period t1*i* to period t5 and from the period t10 to period t14, and is Low from the period t6 to period t9, and the potential of the node MRY is High from the period t1*i* to period t7 and in the period t14, and is Low from the period t8 to period t13.

In a case where the refresh period T2 is continued thereafter, the operations of period t3 to period t14 are repeated. In a case in which new data is written in, the refresh period T2 is terminated and the entire refresh operation mode is released.

The above description explains FIG. 5.

An order to carry out the entire refresh operation can be generated not by an external signal but by a clock generated inside, for example with an oscillator or the like. This eliminates the need to have an external system input a refresh order every fixed time, and is advantageous in that a flexible system configuration is attainable. In a dynamic memory circuit using the pixel memories MR according to the present embodiment, the entire refresh operation is not necessarily carried out by scanning per gate line GL(i), and can be carried out collectively for the entire array. Hence, it is possible to eliminate a peripheral circuit required with a common conventional dynamic memory circuit to refresh while carrying out destructive read of the potential of the source line SL(j).

The following description explains FIG. 6.

In FIG. 6, Low is written into the pixel memory MR as the second potential level in the write-in period T1*i*. However, other than that the potential of the source line SL(j) in the write-in period T1*i* is Low, the change in the potentials of the gate line GL(i), the data transfer control line DT(i), and the refresh output control line RC(i) in each of the periods, are identical to that of FIG. 5.

Hence, the potential of node PIX is Low from the period t1*i* to period t3 and from the period t12 to period t14, and is High from the period t4 to period t11, and the potential of the node MRY is Low from the period t1*i* to period t7 and in the period t14, and is High from the period t8 to period t13.

Illustrated in (a) through (h) of FIG. 3 are transitions of the states of the pixel memory MR. The operation steps of the pixel memory MR in FIG. 5 and FIG. 6 can be divided as described below.

(1) First Step (Period t1*i* to Period t2*i* (Write-In Period T1*i*))

In the first step, a binary logic level is written into the pixel memory MR by having the switch circuit SW1 conduct electricity in a state in which (a) the binary logic level corresponding to the data is supplied to the source line SL(j) from the drive signal generation circuit/video signal generation circuit 4 and (b) the second operation has been carried out by the refresh output control section RS1, and a transfer operation is carried out by the data transfer section TS1 in a state in which (a) the binary logic level is written in the pixel memory MR, and (b) the second operation has been carried out by the refresh output control section RS1.

(2) Second Step (Each of Period t3 to Period t4 and Period t9 to Period t10)

Following the first step, the second step conducts electricity through the switch circuit SW1 in a state in which (a) the second operation has been carried out by the refresh output control section RS1 and (b) a non-transfer operation has been carried out by the data transfer section TS1, to input to the first data storage section DS1 via the source line SL(j), a binary logic level of a level corresponding to control information that causes the refresh output control section RS1 to be in an active state.

(3) Third Step (Each of Period t5 to Period t6 and Period t11 to Period t12)

Following the second step, the third step carries out the first operation by the refresh output control section RS1 in a state in which (a) the switch circuit SW1 is disconnected and (b) a non-transfer operation has been carried out by the data transfer section TS1, and at a time of terminating the first operation, the state is to be in a state in which a binary logic level is inputted to the refresh output control section RS1 from the supply source VS1, which binary logic level is that of an inverted level of a level that corresponds to control information that causes the refresh output control section RS1 to be in an active state.

(4) Fourth Step (Each of Period t7 to Period t8 and Period t13 to Period t14)

Following the third step, the fourth step carries out a transfer operation by the data transfer section TS1, in a state in which (a) the switch circuit SW1 is disconnected and (b) the second operation has been carried out by the refresh output control section RS1.

As the entire write-in operation, the first step is first carried out, and following the first step, the series of operations (period t3 to period t8) from the start of the second step to the end of the fourth step are carried out at least once.

The liquid crystal capacitor Clc illustrated in FIG. 4 is a capacitor in which a liquid crystal layer is disposed between the node PIX and the common electrode COM. Namely, the node PIX is connected to the pixel electrode. At this time, the capacitor Ca1 also functions as a storage capacitor of the pixel 40. Moreover, the transistor N1 which makes up the switch circuit SW1 also functions as a selection element of the pixel 40. The common electrode COM is provided on a common electrode substrate (counter substrate) that faces the active matrix substrate on which the circuit of FIG. 1 is formed. However, the common electrode COM may be provided on the same substrate as the active matrix substrate.

In the multiple tone display mode, display is carried out by the pixel memory MR by supplying to the pixel 40 a data signal that has a greater number of potential levels than the binary level and in a state in which no first operation is carried out, which first operation causes the refresh control section RS1 to be in the active state. In the multiple tone display mode, just the capacitor Ca1 can be functioned as a storage capacitor by fixing the potential of the data transfer control line DT(i) as Low, or the capacitor Ca1 and capacitor Cb1 together can be functioned as a storage capacitor by fixing the potential of the data transfer control line DT(i) as High. Moreover, by fixing the potential of the refresh output control line RC(i) as Low and maintaining the transistor N4 as in the OFF state, the potential of the data transfer control line DT(i) can be made so that it does not affect a display tone of the liquid crystal capacitor Clc, which display tone is determined by an electric charge stored in the first data storage section DS1, and can achieve a display performance the same as a liquid crystal display device that does not have the memory function.

Moreover, in the memory circuit operation mode of FIG. 5, the potential of the common electrode COM is driven so as to be inverted between High and Low every time the transistor N1 switches to the ON state. If the High potential of the common electrode COM is equal to the High potential of the binary logic level, and the Low potential of the common electrode COM is equal to the Low potential of the binary logic level, a black display of a positive polarity is achieved when the potential of the node PIX is Low and a white display of a positive polarity is achieved when the potential of the node PIX is High, each while the potential of the common electrode COM is Low, and while the potential of the common electrode COM is High, a white display of a negative polarity is achieved when the potential of the node PIX is Low and a black display of a negative polarity is achieved when the potential of the node PIX is High. As a result, the liquid crystal is driven so that a direction of a voltage applied to a liquid crystal is inverted every time the potential of the node PIX is refreshed, while the liquid crystal maintains its display tone for the most part. This allows for carrying out AC drive of the liquid crystal, in which positive and negative effective values of a voltage applied on the liquid crystal become fixed. Moreover, the potential (two values) of the common electrode COM may be configured to be larger than a minimum value of the data signal potential and be smaller than a maximum value of the data signal potential.

As illustrated in FIG. 5, the potential polarity of the common electrode COM is inverted during a period in which the node PIX is fixed at a potential of a source line SL(j) as a state in which the transistor N1 is in the ON state. Hence, it is possible to prevent the potential of the node PIX from changing such as a case of changing a potential polarity of the common electrode COM while the node PIX is floating.

As described above, according to the present embodiment, it is possible to have a display device possess both functions of the multicolor display mode (first display mode) and the memory operation mode (second display mode). During the memory operation mode, display of an image with a relatively less time variation such as a still image allows for stopping circuits for example an amplifier and data supplying operations, each used for displaying a multiple tone image with a video signal generation circuit. Accordingly, it is possible to attain low power consumption. Furthermore, during the memory operation mode, the potential can be refreshed within the pixel 40. For this reason, it is not necessary to rewrite data of the pixel 40 while again charging and discharging the source line SL(j). As a result, it is possible to reduce the power consumption. Moreover, since the data polarity can be inverted inside the pixel 40, there is no need to rewrite the display data inverted at the time of inverting the polarity while charging and discharging the source line SL(j). This thus allows for reduction of power consumption.

The pixel memories MR of Embodiment 1 may be disposed inside a drive circuit such as inside a CS driver of a display device. In such a case, examples of use include, for example using the binary logic level of stored data as a direct output from the pixel memory MR. With use of the pixel memory MR illustrated in FIG. 4, it is possible to form the memory cell in a drive circuit produced monolithically onto a display panel prepared by amorphous silicon, since the transistors are all made of the N-channel TFT.

The memory circuit MR1 may be a TFT (field effect transistor) in which all transistors making up the memory circuit is of a P-channel.

EXAMPLE 1

Next described is a specific configuration of the pixels 40, in the liquid crystal panel including the pixel memory MR of the foregoing configuration.

Figure 7:
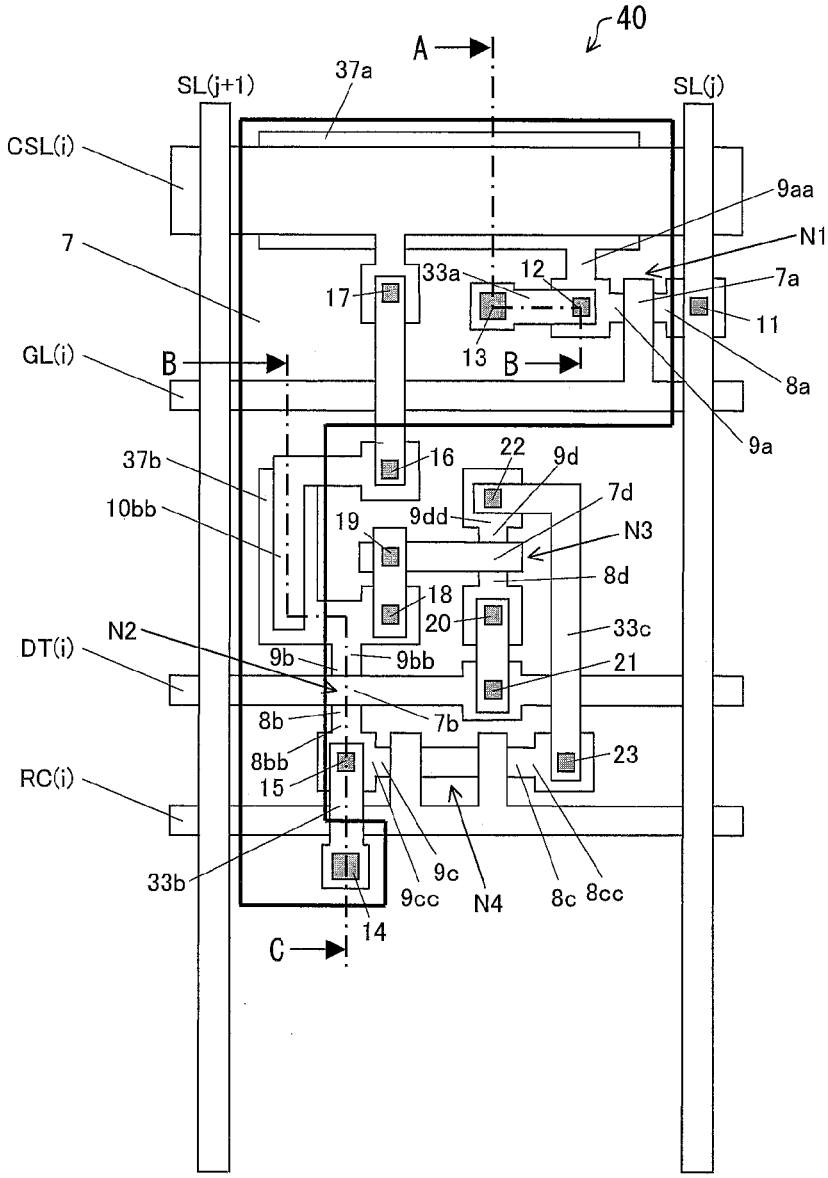
FIG. 7 is a plan view illustrating a specific example (Example 1) of a liquid crystal panel in the present liquid crystal display device.

FIG. 7 illustrates a plan view of one pixel of the present liquid crystal panel. In the liquid crystal panel of FIG. 7, the source line SL(j) is provided in a column direction along the pixel 40, and the CS line CSL(i), the gate line GL(i), the data transfer control line DT(i), and the refresh output control line RC(i) are provided in a row direction so as to pass across the pixel 40. The pixel electrode 7 is formed as a rectangular shape overlapping the CS line CSL(i) and the gate line GL(i), and an edge section thereof extends in the column direction and is formed so that the extended part overlaps the conductive terminals of the transistors N2 and N4.

In the pixel 40, a gate electrode 7*a* is connected to the gate line GL(i), and a source electrode 8*a* and drain electrode 9*a* of a transistor N1 (first transistor) are so formed as to correspond to the gate electrode 7*a*. The source electrode 8*a* is connected to the source line SL(j) via a contact hole 11. The drain electrode 9*a* is connected to a draw-out wire 9*aa*, and the draw-out wire 9*aa* is connected to a relay line 33*a* via a contact hole 12, and the relay line 33*a* is connected to the pixel electrode 7 via a contact hole 13 (first contact hole). Moreover, the draw-out wire 9*aa* is connected to a capacitor electrode 37*a* (first capacitor electrode), and the capacitor electrode 37*a* is overlapped by the CS line CSL(i) with a gate insulating film sandwiched between the capacitor electrode and the CS line, which forms a storage capacitor Ca1 (first storage capacitor) (see FIG. 4).

The pixel electrode 7 is connected to a relay line 33*b* via a contact hole 14 (second contact hole), and the relay line 33*b* is connected to a source electrode 8*b* (conductive terminal) of the transistor N2 (second transistor) via a contact hole 15 and also is connected to a drain electrode 9*c* (conductive terminal) of the transistor N4 (fourth transistor) via the contact hole 15. The gate electrode 7*b* (control terminal) of the transistor N2 is connected to the data transfer control line DT(i), a drain electrode 9*b* of the transistor N2 is connected to a draw-out wire 9*bb*, and the draw-out wire 9*bb* is connected to a capacitor electrode 37*b* (second capacitor electrode). The capacitor electrode 37*b* is overlapped by the CS extension section 10*bb* (storage capacitor line extension section) in such a manner that a gate insulating film is sandwiched between the capacitor electrode 37*b* and the CS extension section 10*bb*, and the CS extension section 10*bb* is connected to the CS line CSL(i) via contact holes 16 and 17. This forms a storage capacitor Cb1 (second storage capacitor) (see FIG. 4).

The draw-out wire 9*bb* connected to the drain electrode 9*b* of the transistor N2 is further connected to a gate electrode 7*d* (control terminal) of the transistor N3 (third transistor) via contact holes 18 and 19, and a source electrode 8*d* (conductive terminal) of the transistor N3 is connected to the data transfer control line DT(i) via contact holes 20 and 21. A drain electrode 9*d* of the transistor N3 is connected to a relay line 33*c* via a contact hole 22, and the relay line 33*c* is connected to a source electrode 8*c* of the transistor N4 via a contact hole 23. A gate electrode (control terminal) of the transistor N4 is connected to the refresh output control line RC(i).

As described above, the pixel electrode 7 has two contact holes 13 and 14; the pixel electrode 7 is connected to one of conductive terminals of the transistor N1 via the contact hole 13, and is connected to one of conductive terminals of each of the transistors N2 and N4, via the contact hole 14.

Figure 8:
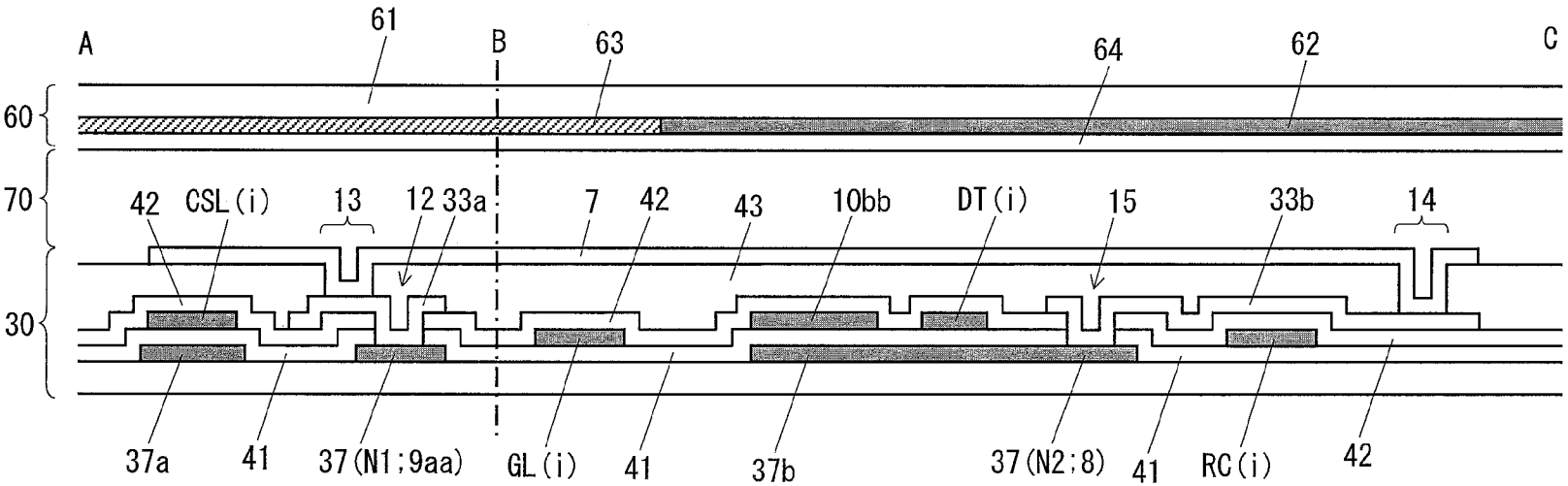
FIG. 8 is a cross sectional view taken on line A-B-C in FIG. 7.

FIG. 8 is a cross sectional view taken on A-B-C of FIG. 7. As illustrated in FIG. 8, the present liquid crystal panel includes an active matrix substrate 30, a color filter substrate 60 (counter substrate) facing the active matrix substrate 30, and a liquid crystal layer 70 disposed between the two substrates 30 and 60.

The active matrix substrate 30 has, formed on a glass substrate 31, a semiconductor layer 37 (i layer and n+ layer), the source electrodes 8*a*, 8*b*, 8*c*, 8*d* which are in contact with the n+ layer (see FIG. 7), the drain electrodes 9*a*, 9*b*, 9*c*, 9*d* (see FIG. 7), the draw-out wires 9*aa*, 9*bb*, 9*cc*, 9*dd* (see FIG. 7) drawn out from the drain electrodes 9*a*, 9*b*, 9*c*, 9*d*, respectively, and the capacitor electrode 37*a*, and an inorganic gate insulating film 41 is formed so as to cover these members. On the inorganic gate insulating film 41, the CS line CSL(i), the gate line GL(i), the CS extension section 10*bb*, the data transfer control line DT(i), and the refresh output control line RC(i) are formed, and an inorganic interlayer insulating film 42 is formed so as to cover these lines. On the inorganic interlayer insulating film 42, the relay lines 33*a* and 33*b* are formed, and an organic interlayer insulating film 43 is formed so as to cover these relay lines 33*a* and 33*b*. On the organic interlayer insulating film 43, the pixel electrode 7 is formed, and furthermore an alignment film (not illustrated) is formed so as to cover the pixel electrode 7.

The organic interlayer insulating film 43 is hollowed through entirely at the contact hole 13; this connects the pixel electrode 7 with the relay line 33*a*. Moreover, at the contact hole 12, the inorganic gate insulating film 41 and the inorganic interlayer insulating film 42 are hollowed through, which connects the draw-out wire 9*aa* drawn out from the drain electrode 9*a* (see FIG. 7) of the transistor N1 with the relay line 33*a*. The capacitor electrode 37*a* connected to the draw-out wire 9*aa* is overlapped by the CS line CSL(i) in such a manner that the inorganic gate insulating film 41 is sandwiched between the capacitor electrode 37*a* and the CS line CSL(i); this forms the storage capacitor Ca1 (see FIG. 4).

The organic interlayer insulating film 43 is hollowed through at the contact hole 14, which connects the pixel electrode 7 with the relay line 33*b*. Moreover, the inorganic gate insulating film 41 and the inorganic interlayer insulating film 42 are hollowed through at the contact hole 15; this connects the draw-out wire 9*bb* drawn out from the drain electrode 9*b* (see FIG. 7) of the transistor N2 with the relay line 33*b*. The capacitor electrode 37*b* connected to the draw-out wire 9*bb* is overlapped by the CS extension section 10*bb* in such a manner that the inorganic gate insulating film 41 is sandwiched between the capacitor electrode 37*b* and the CS extension section 10*bb*, and the CS extension section 10*bb* is connected to the CS line CSL(i) via the contact holes 16 and 17. As a result, the storage capacitor Cb1 (see FIG. 4) is formed between the capacitor electrode 37*b* and the CS extension section 10*bb*.

On the other hand, the color filter substrate 60 has a black matrix 62 and a colored layer 63 formed on a glass substrate 61, and on an upper layer thereof, a common electrode (com) 64 is formed. Furthermore, an alignment film (not illustrated) is formed so as to cover the common electrode 64.

Figure 18:
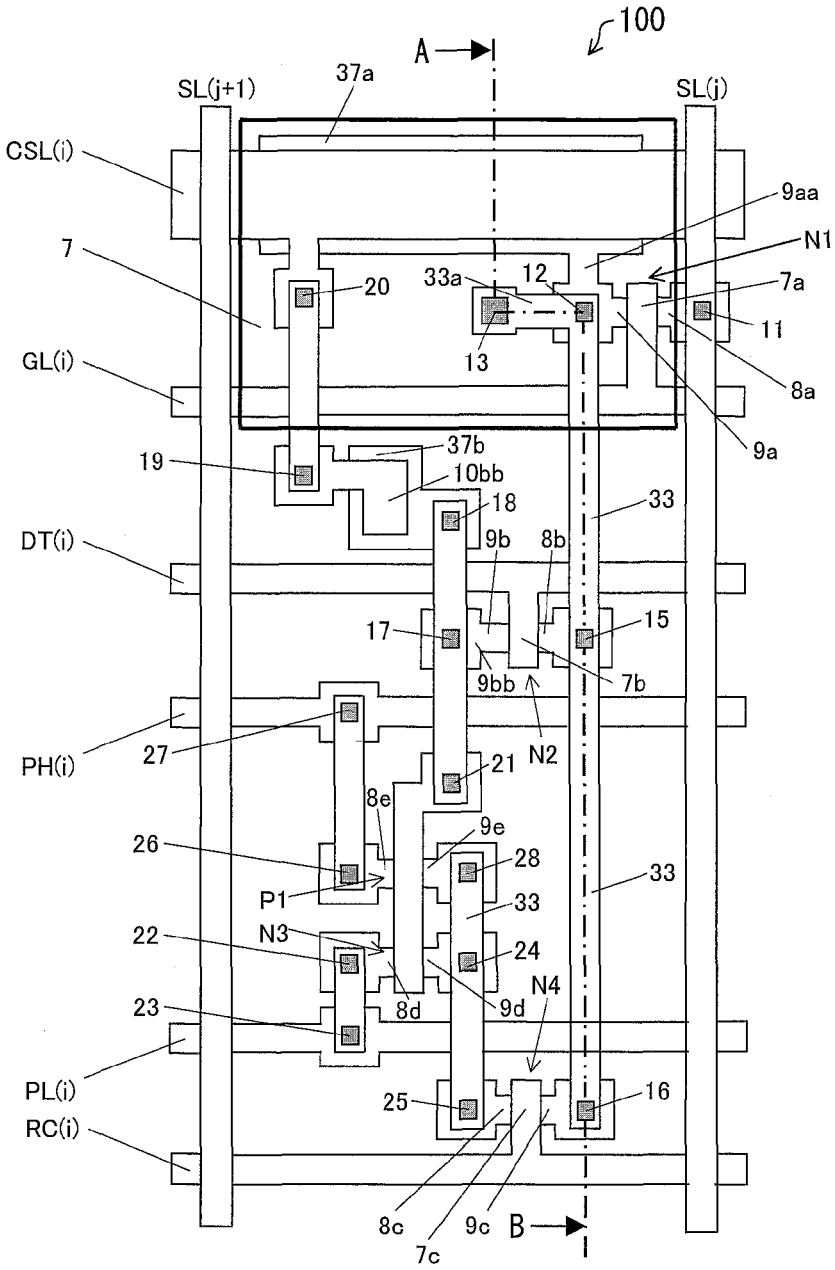
FIG. 18 is a plan view illustrating a specific example of a liquid crystal panel in a conventional liquid crystal display device.
Figure 19:
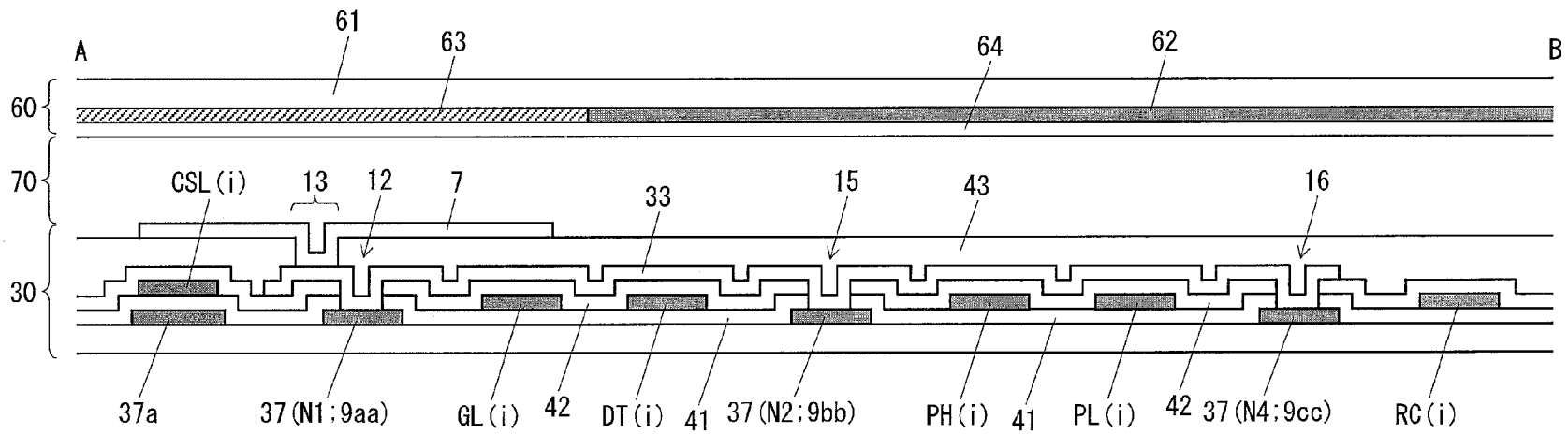
FIG. 19 is a cross sectional view taken on line A-B in FIG. 18.

According to the pixel configuration, it is possible to reduce the number of signal lines as compared to a conventional substrate (see FIG. 18). Particularly, with the present liquid crystal panel, the transistors N1, N2, and N4 are connected via the two contact holes opened in the pixel electrode 7. More specifically, a conductive terminal of the transistor N1 is connected to the pixel electrode 7 via the contact hole 13, and a conductive terminal of each of the transistors N2 and N4 is connected to the pixel electrode 7 via the contact hole 14. This allows for omitting a conventionally-used relay line (relay line 33 in FIG. 18, disposed between the contact holes 12 and 16), which relay line extends in the column direction so as to intersect with the gate line GL(i), the data transfer control line DT(i), and the refresh output control line RC(i), each of which line runs across a pixel (extends in the row direction). As a result, it is possible to reduce short-circuiting between the signal lines and malfunctions caused by noise generated between the signal lines. Furthermore, it is possible to improve a yield rate.

Figure 9:
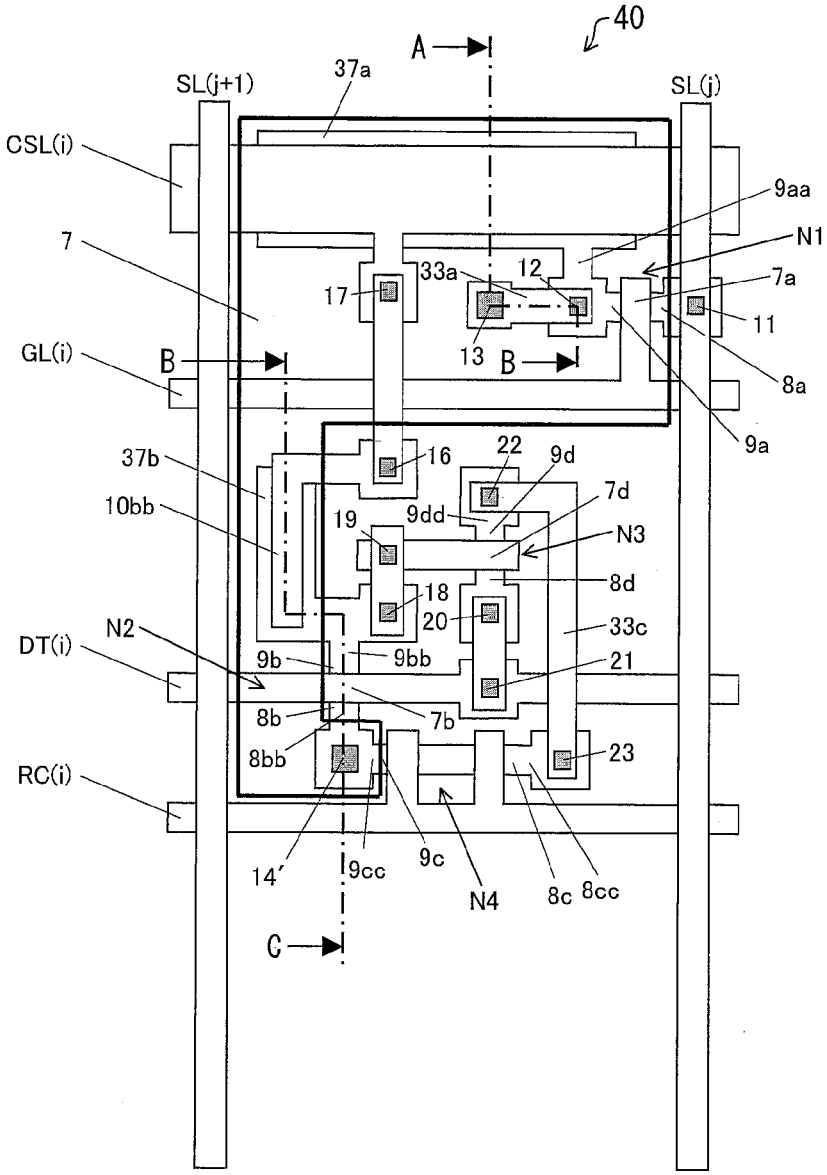
FIG. 9 is a plan view illustrating another specific example of the liquid crystal panel illustrated in FIG. 7.

The pixel 40 of FIG. 7 may be modified as illustrated in FIG. 9. Namely, the edge section of the pixel electrode 7 is extended to a position that overlaps the draw-out wires 8*bb* and 9*cc* of the transistors N2 and N4, and the pixel electrode 7 is connected with the draw-out wires 8*bb* and 9*cc* via a contact hole 14'. This permits a substitution for the two contact holes 14 and 15 of FIG. 7 with one single contact hole 14', thereby allowing for omitting the relay line 33*b* in FIG. 7.

Figure 10:
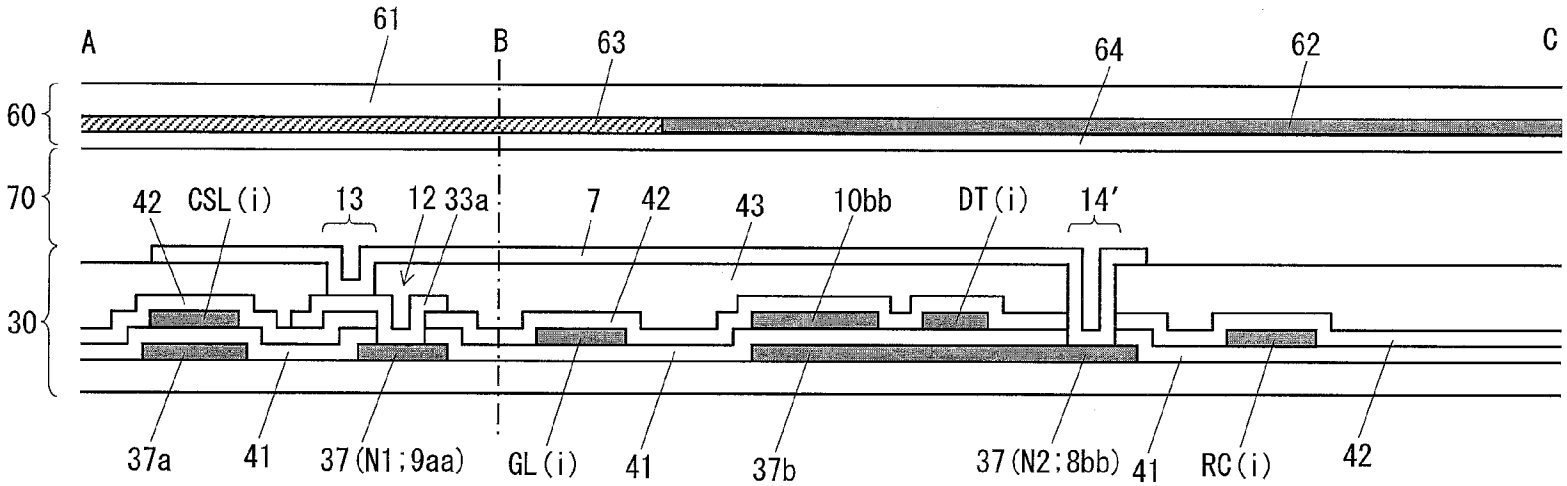
FIG. 10 is a cross sectional view taken on line A-B-C in FIG. 9.

FIG. 10 is a cross sectional view taken on A-B-C of FIG. 9. As illustrated in FIG. 10, the interlayer insulating films 43 and 42 and the gate insulating film 41 are hollowed through at the contact hole 14'; this connects the pixel electrode 7 with the draw-out wires 8*bb* and 9*cc*.

Figure 11:
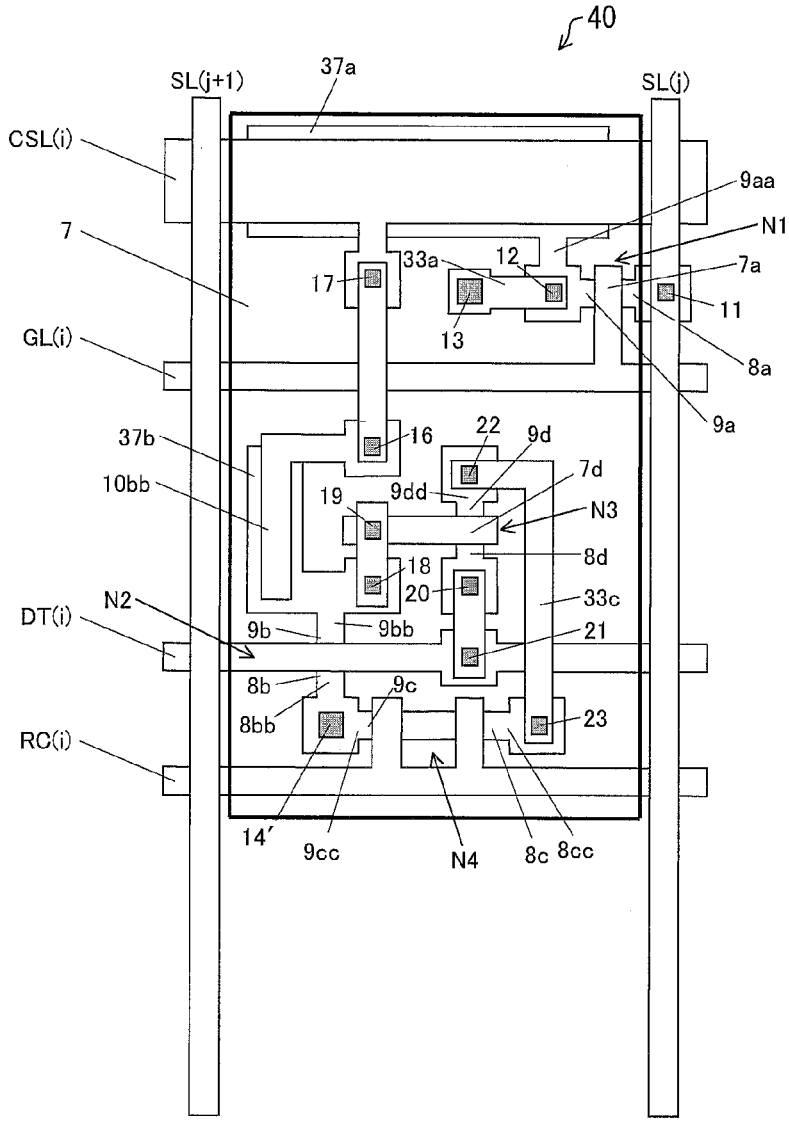
FIG. 11 is a plan view illustrating another specific example of the liquid crystal panel illustrated in FIG. 7.

The pixel 40 of FIG. 7 and FIG. 9 may also be modified as illustrated in FIG. 11. Namely, the pixel electrode 7 is formed as a rectangular shape so as to cover the entire pixel area.

Moreover, the number of contact holes formed on the pixel electrode 7 is not limited to two, and may be three or more. Namely, in the present liquid crystal display device, the pixel electrode 7 includes at least two contact holes including a first contact hole and a second contact hole, and the pixel electrode 7 is connected to one of conductive terminals of the first transistor (N1) via the first contact hole (13) and is connected to one of conductive terminals of the second transistor (N2) and one of conductive terminals of the fourth transistor (N4), via the second contact hole (14).

EXAMPLE 2

Figure 12:
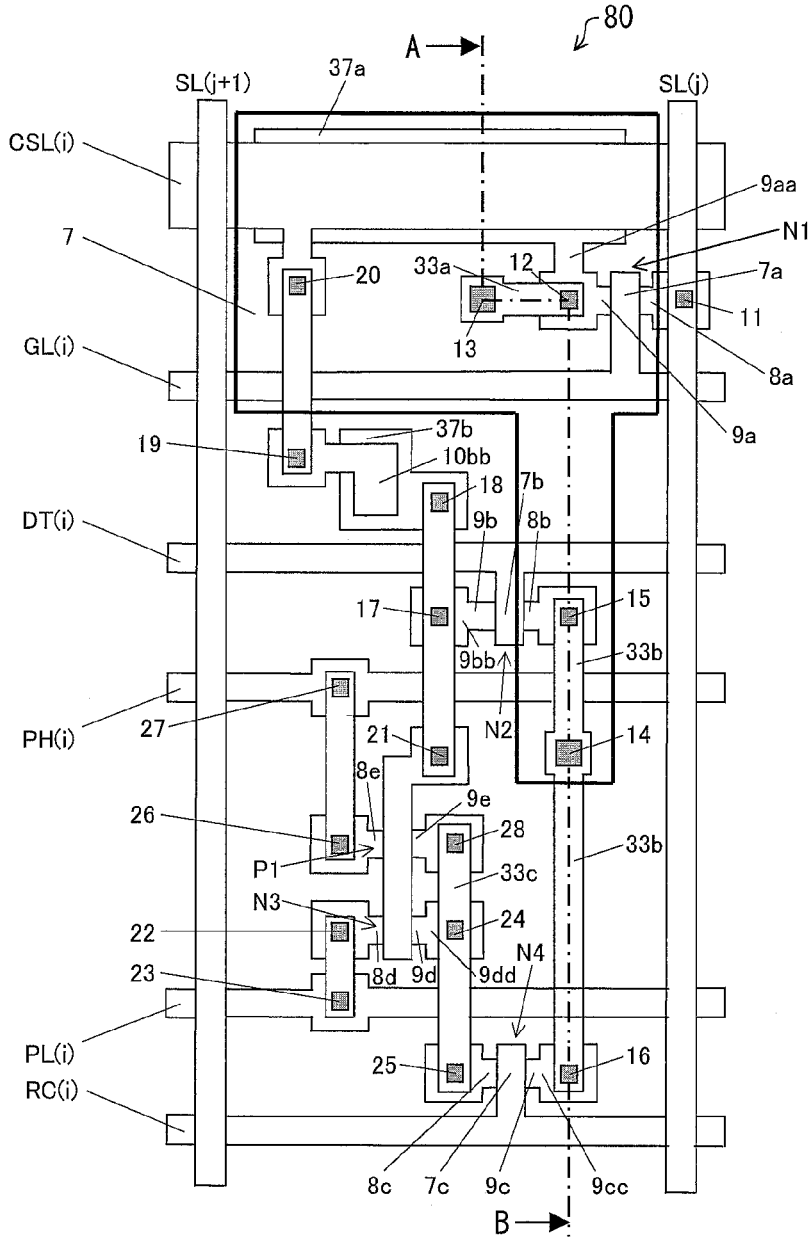
FIG. 12 is a plan view illustrating a specific example (Example 2) of a liquid crystal panel in the present liquid crystal display device.

The liquid crystal display device according to the present invention is not limited to the configuration illustrated in Example 1. FIG. 12 is a plan view of one pixel of a case where the present invention is employed in a liquid crystal panel in which a conventional pixel memory MR (FIG. 17) is provided.

In the liquid crystal panel of FIG. 12, the source line SL(j) is disposed in the column direction along a pixel 80, and the CS line CSL(i), the gate line GL(i), the data transfer control line DT(i), a high power source line PH(i) (high potential power line), a low power source line PL(i) (low potential power line), and the refresh output control line RC(i) are provided in the row direction, each running across the pixel 80. The pixel electrode 7 is formed in a rectangular shape so as to overlap the CS line CSL(i) and the gate line GL(i), and an edge section of the pixel electrode 7 extends in the column direction and is shaped to overlap a conductive electrode of the transistor N2.

Figure 17:
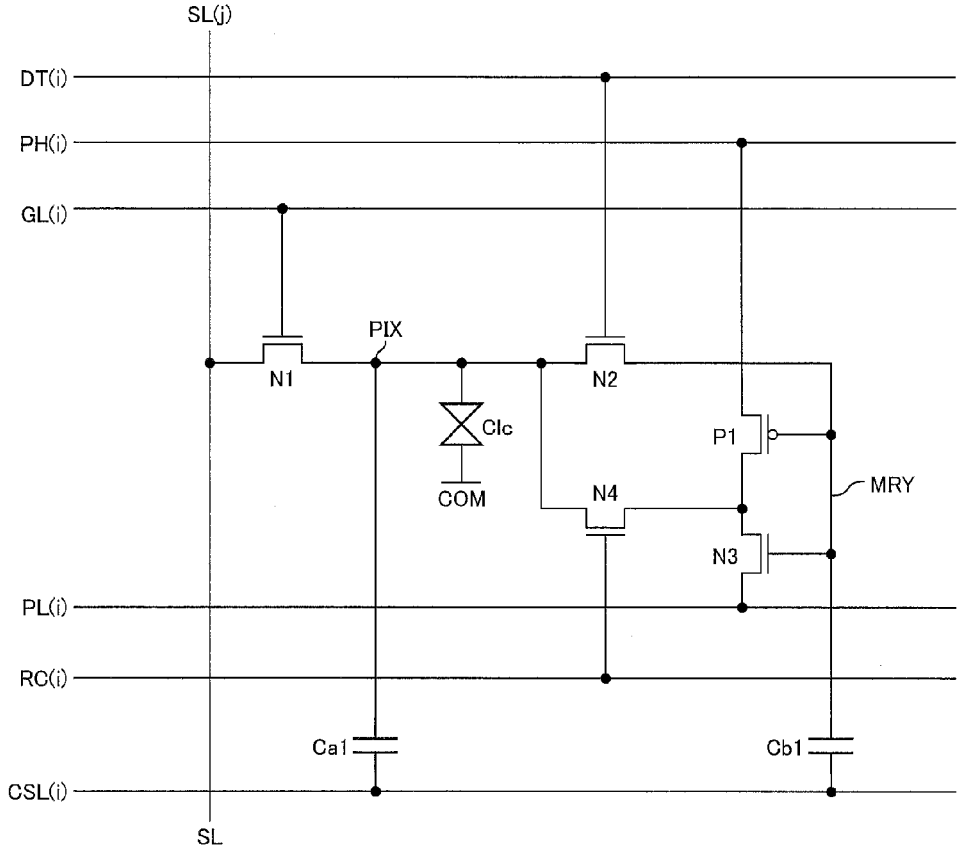
FIG. 17 is a circuit diagram illustrating a configuration of a pixel memory in a conventional liquid crystal display device.

In the pixel 80, the gate electrode 7*a* is connected to the gate line GL(i), and the source electrode 8*a* and the drain electrode 9*a* of the transistor N1 (first transistor) are so formed as to correspond to the gate electrode 7*a*. The source electrode 8*a* is connected to the source line SL(j) via a contact hole 11. The drain electrode 9*a* is connected to the draw-out wire 9*aa*. The draw-out wire 9*aa* is connected to the relay line 33*a* via a contact hole 12, and the relay line 33*a* is connected to the pixel electrode 7 via a contact hole 13 (first contact hole). Moreover, the draw-out wire 9*aa* is connected to the capacitor electrode 37*a*, and the capacitor electrode 37*a* is overlapped by the CS line CSL(i) in such a manner that a gate insulating film is sandwiched between the capacitor electrode 37*a* and the CS line CSL(i). This forms a storage capacitor Ca1 (first storage capacitor) (FIG. 17).

The pixel electrode 7 is connected to the relay line 33*b* via a contact hole 14 (second contact hole). The relay line 33*b* is connected to the source electrode 8*b* (conductive terminal) of the transistor N2 (second transistor) via a contact hole 15 and to the drain electrode 9*c* (conductive terminal) of the transistor N4 (fourth transistor) via a contact hole 16. The gate electrode 7*b* (control terminal) of the transistor N2 is connected to the data transfer control line DT(i), the drain electrode 9*b* of the transistor N2 is connected to the draw-out wire 9*bb*, and the draw-out wire 9*bb* is connected to the capacitor electrode 37*b* via contact holes 17 and 18. The capacitor electrode 37*b* is overlapped by the CS extension section 10*bb* in such a manner that a gate insulating film is sandwiched between the capacitor electrode 37*b* and the CS extension section 10*bb*, and the CS extension section 10*bb* is connected to the CS line CSL(i) through contact holes 19 and 20. This forms a storage capacitor Cb1 (second storage capacitor) (FIG. 17).

The drain electrode 9*b* of the transistor N2 is connected to the gate electrodes of the transistors N3 (third transistor) and P1 (fifth transistor) via contact holes 17 and 21, and the source electrode 8*d* of the transistor N3 is connected to the low power line PL(i) via contact holes 22 and 23. The drain electrode 9*d* of the transistor N3 is connected to the relay line 33*c* via a contact hole 24, and the relay line 33*c* is connected to the source electrode 8*c* of the transistor N4 via a contact hole 25. The gate electrode 7*c* of the transistor N4 is connected to the refresh output control line RC(i), and the drain electrode 9*c* of the transistor N4 is connected to the relay line 33*b* as described above.

A source electrode 8*e* of the transistor P1 is connected to the high power line PH(i) via contact holes 26 and 27, and the drain electrode 9*e* of the transistor P1 is connected to the relay line 33*c* via the contact hole 28.

As described above, the pixel electrode 7 has two contact holes 13 and 14, and the pixel electrode 7 is connected to one of conductive terminals of the transistor N1 via the contact hole 13 and to one of conductive terminals of the transistor N2 via the contact hole 14.

Figure 13:
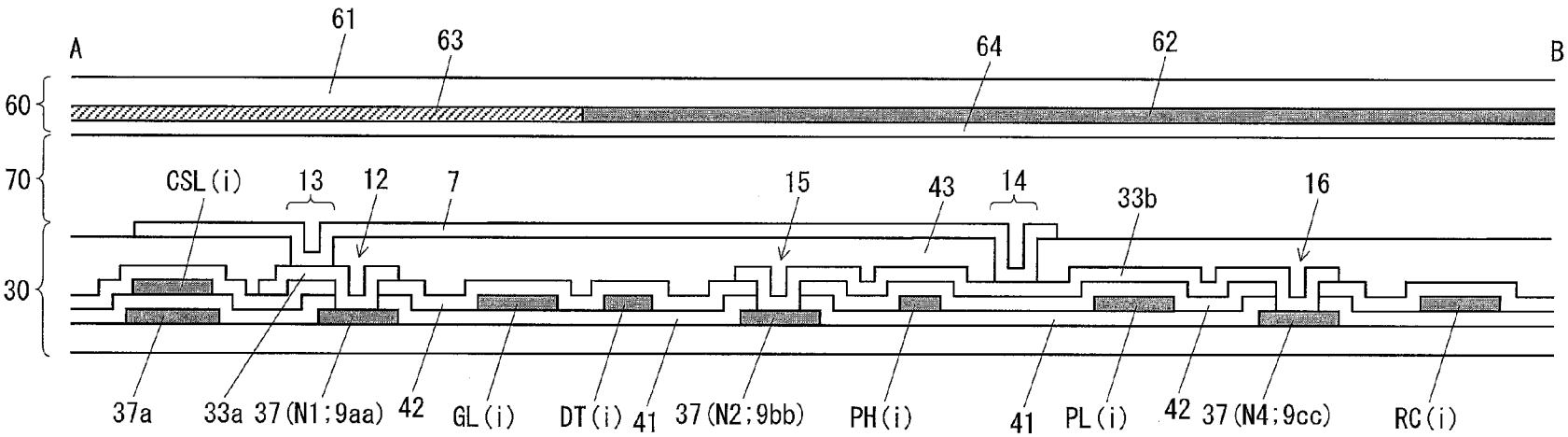
FIG. 13 is a cross sectional view taken on line A-B in FIG. 12.

FIG. 13 is a cross sectional view of A-B in FIG. 12. As illustrated in FIG. 13, the present liquid crystal panel includes the active matrix substrate 30, the color filter substrate 60 facing the active matrix substrate 30, and the liquid crystal layer 60 disposed between the substrates 30 and 70.

The active matrix substrate 30 has, on the glass substrate 31, the semiconductor layer 37 (i layer and n+ layer), the source electrodes 8*a*, 8*b*, 8*c*, 8*d* which are in contact with the n+ layer (see FIG. 12), the drain electrodes 9*a*, 9*b*, 9*c*, 9*d* (see FIG. 12), the draw-out wires 9*aa*, 9*bb*, 9*cc*, 9*dd* (see FIG. 12) drawn out from the drain electrodes 9*a*, 9*b*, 9*c*, 9*d*, respectively, and the capacitor electrode 37*a*, and an inorganic gate insulating film 41 is formed so as to cover these members. On the inorganic gate insulating film 41, the CS line CSL(i), the gate line GL(i), the data transfer control line DT(i), the high power line PH(i), the low power line PL(i), and the refresh output control line RC(i) are formed, and an inorganic interlayer insulating film 42 is formed so as to cover these members. The inorganic interlayer insulating film 42 has the relay line 33*b* be formed thereon, in a direction intersecting with each of the high power line PH(i) and low power line PL(i), and an organic interlayer insulating film 43 is formed so as to cover the relay line 33*b*. The pixel electrode 7 is formed on the organic interlayer insulating film 43, and an alignment film (not illustrated) is formed so as to cover the pixel electrode 7.

The organic interlayer insulating film 43 is hollowed through at the contact hole 13; this connects the pixel electrode 7 with the relay line 33*a*. Moreover, the inorganic gate insulating film 41 and the inorganic interlayer insulating film 42 are hollowed through at the contact hole 12, which connects the draw-out wire 9*aa* drawn out from the drain electrode 9*a* (see FIG. 12) of the transistor N1 with the relay line 33*a*. The capacitor electrode 37*a* connected to the draw-out wire 9*aa* is overlapped by the CS line CSL(i) in such a manner that an inorganic gate insulating film 41 is sandwiched between the capacitor electrode 37*a* and the CS line CSL(i). This forms the storage capacitor Ca1 (see FIG. 17).

The organic interlayer insulating film 43 is hollowed through at the contact hole 14, which connects the pixel electrode 7 with the relay line 33*b*. Moreover, the inorganic gate insulating film 41 and the inorganic interlayer insulating film 42 are hollowed through at the contact hole 15, which connects the draw-out wire 9*bb* drawn out from the drain electrode 9*b* (see FIG. 12) of the transistor N2, with the relay line 33*b*. The inorganic gate insulating film 41 and the inorganic interlayer insulating film 42 are hollowed through at the contact hole 16, which connects the draw-out wire 9*cc* drawn out from the drain electrode 9*c* of the transistor N4, with the relay line 33*b*.

Meanwhile, the color filter substrate 60 has, formed on the glass substrate 61, a black matrix 62 and a colored layer 63, and a common electrode (com) 64 is formed on an upper layer thereof. Furthermore, an alignment film (not illustrated) is formed so as to cover the common electrode 64.

According to the foregoing pixel configuration, it is possible to reduce the number of signal lines as compared to a conventional pixel configuration (see FIG. 18). Particularly, in the present liquid crystal panel, the transistors N1 and N2 are connected by means of the two contact holes on the pixel electrode 7. More specifically, a conductive terminal of the transistor N1 is connected to the pixel electrode 7 via the contact hole 13, and a conductive terminal of the transistor N2 is connected to the pixel electrode 7 via the contact hole 14. This allows for omitting the conventionally-used relay line (relay line 33 in FIG. 18, disposed between the contact holes 12 and 15) that extends in the column direction and intersects with the gate line GL(i) and the data transfer control line DT(i) which run across the pixel (extend in the row direction). Consequently, it is possible to reduce the short-circuiting of signal lines and the malfunctions caused by noise generated between the signal lines. Furthermore, it is possible to improve the yield rate.

Figure 14:
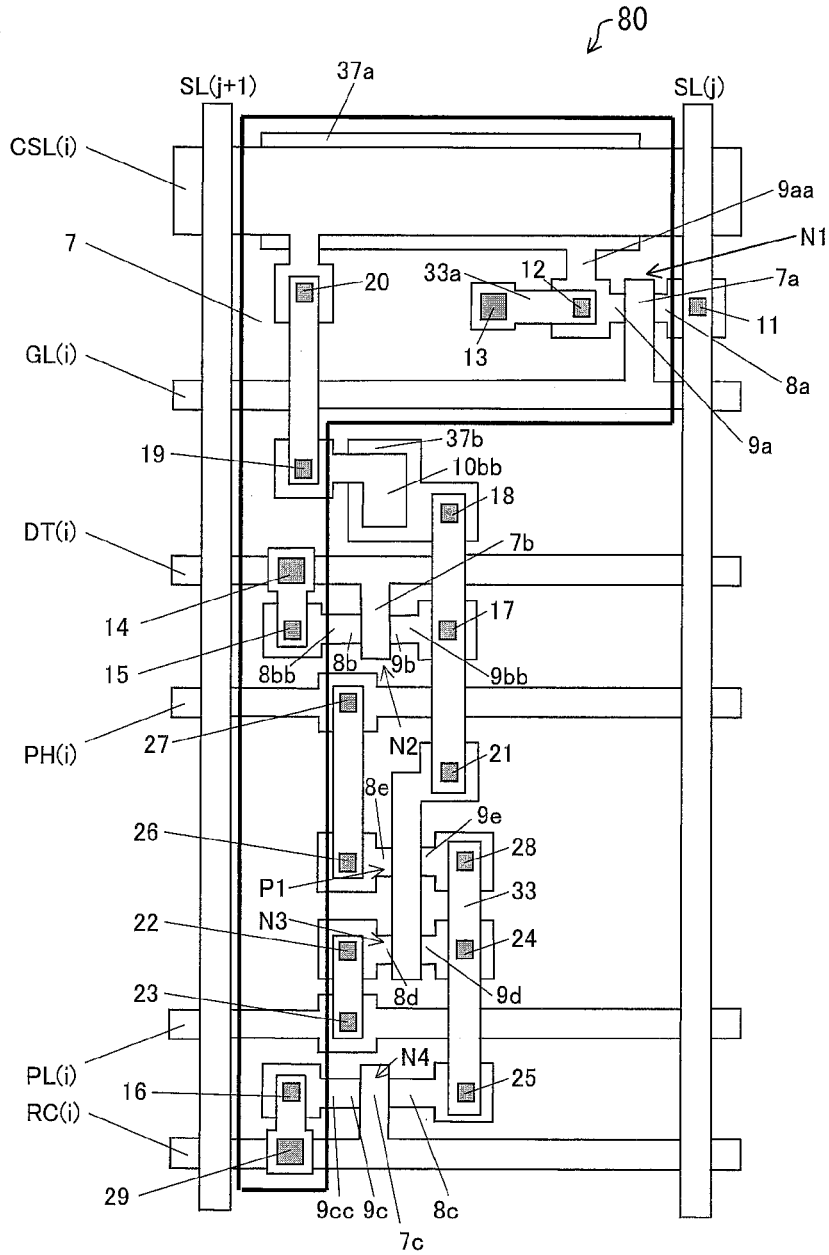
FIG. 14 is a plan view illustrating another specific example of the liquid crystal panel illustrated in FIG. 12.
Figure 15:
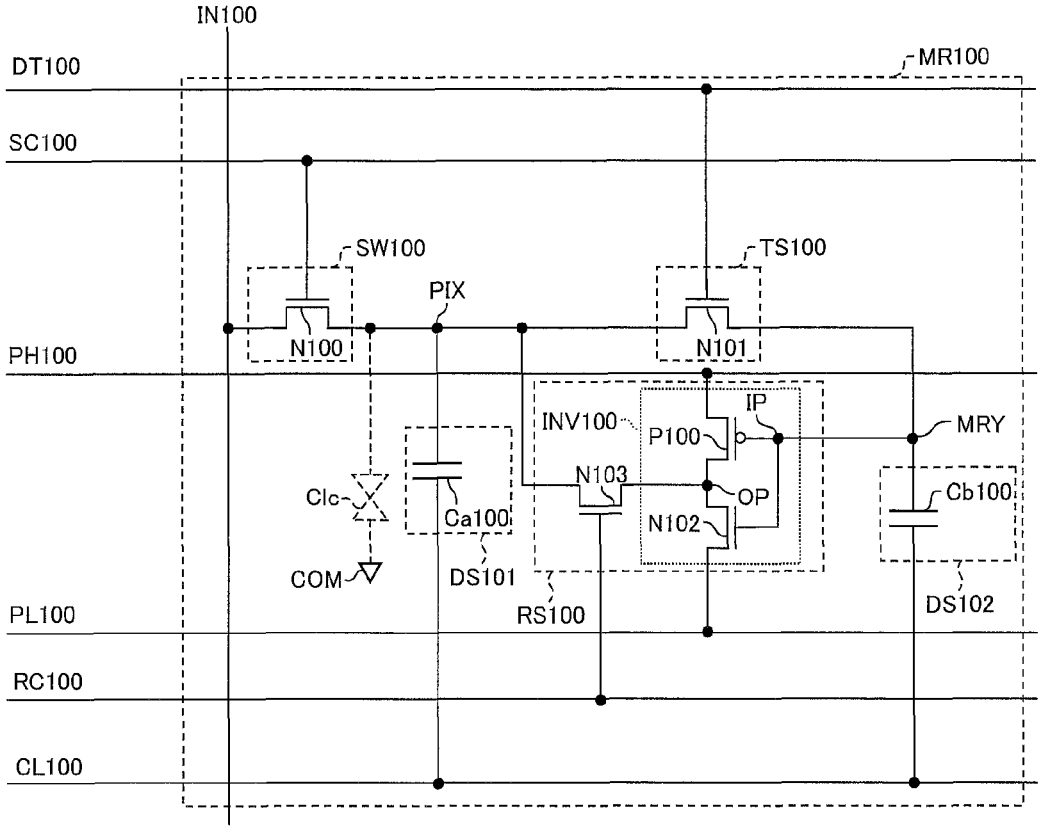
FIG. 15 is a circuit diagram illustrating a configuration of a pixel memory in a conventional liquid crystal display device.
Figure 16:
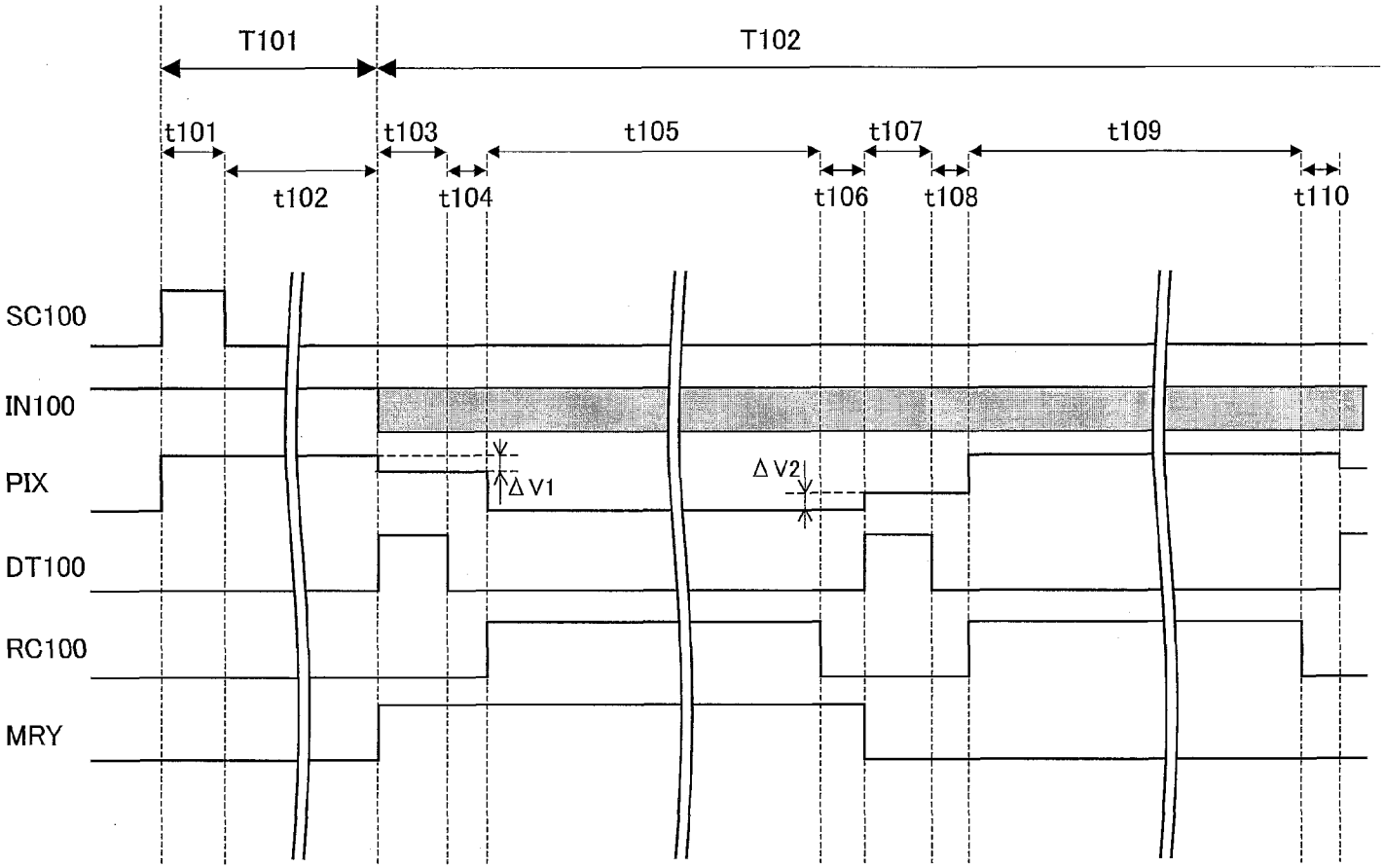
FIG. 16 is a timing chart illustrating an operation of the pixel memory of FIG. 15.

The pixel 80 of FIG. 12 may be modified as illustrated in FIG. 14. Namely, the edge section of the pixel electrode 7 is extended to a position where the pixel electrode 7 overlaps the draw-out wires 8*bb* and 9*cc* of the transistors N2 and N4, respectively, so that the pixel electrode 7 is connected with the draw-out wire 8*bb* via the contact hole 14 and the pixel electrode 7 is connected with the draw-out wire 9*cc* via the contact hole 29. This hence allows for omitting the relay line 33*b* of FIG. 12.

Although not illustrated, the two contact holes 14 and 15 may be merged into one contact hole, and the two contact holes 16 and 29 may be merged into one contact hole, as illustrated in FIG. 9 of Example 1.

Moreover, similarly with Example 1, the number of contact holes in the pixel electrode 7 is not limited to two, and may be three or more.

In order to attain the foregoing object, a liquid crystal display device of the present invention is a memory liquid crystal display device that carries out a refresh operation in a period in which data is held after a data signal potential is written in, the device including: data signal lines; scanning signal lines; storage capacitor lines; data transfer lines; refresh lines; pixel electrodes; a counter electrode; first transistors, each of whose control terminal is connected to a respective one of the scanning signal lines; second transistors, each of whose control terminal is connected to a respective one of the data transfer lines; third transistors, each of whose control terminal is connected to a respective one of the pixel electrodes via a respective one of the second transistors; fourth transistors, each of whose control terminal is connected to a respective one of the refresh lines; first storage capacitors, each of which is connected to a respective one of the pixel electrodes; and second storage capacitors, each of which is connected to the pixel electrode via a respective one of the second transistors, each of the pixel electrodes being connected to a respective one of the data signal lines via a respective one of the first transistors and being connected to a respective one of the data transfer lines via a respective one of the fourth transistor and a respective one of the third transistors, and furthermore, each of the pixel electrodes having at least two contact holes including a first contact hole and a second contact hole, the pixel electrode being connected to one of conductive terminals of the respective first transistor via the first contact hole and being connected to one of conductive terminals of a respective one of the second transistors and one of conductive terminals of the respective fourth transistor via the second contact hole.

According to the configuration, the first transistor, the second transistor, and the fourth transistor are connected via the two contact holes opened in the pixel electrode. More specifically, a conductive terminal of the first transistor is connected to the pixel electrode via the first contact hole, and a conductive terminal of each of the second and fourth transistors are connected to the pixel electrode via the second contact hole. This allows for omitting a conventionally used relay line (relay line 33 in FIG. 18, disposed between the contact holes 12 and 16) which extends in a column direction and intersects with a scanning signal line, a data transfer line, and a refresh line, each of which extends in the row direction. As a result, it is possible to reduce short-circuiting of signal lines and malfunctions caused by noise generated between the signal lines, as compared to a conventional configuration (see FIG. 18). Furthermore, this allows for improving a yield rate.

The present liquid crystal display device may be configured in such a manner that while the data signal potential is written in, the data transfer lines are made active and the scanning signal lines are successively selected while the data signal potential is outputted to the data signal lines.

The present liquid crystal display device may be configured in such a manner that during the period in which data is held, the data signal lines are provided with a constant potential that makes the third transistors be switched ON.

The present liquid crystal display device may be configured in such a manner that during the period in which data is held, the refresh operation is carried out by once activating the scanning signal lines simultaneously and thereafter activating the refresh lines simultaneously, while the data transfer lines are inactive.

The present liquid crystal display device may be configured in such a manner that the counter electrode has its potential be alternated between two values each time the refresh operation is carried out.

The present liquid crystal display device may be configured in such a manner that the two values are both larger than a minimum value of the data signal potential but are smaller than a maximum value of the data signal potential.

The present liquid crystal display device may be configured so as to include: first capacitor electrodes, each of which is connected to a respective one of the pixel electrodes via the first contact hole; and second capacitor electrodes, each of which is connected to a respective one of the pixel electrodes via the second contact hole, each of the first storage capacitors being formed by having the storage capacitor lines and corresponding first capacitor electrodes overlap each other, with an insulating film provided therebetween, and each of the second storage capacitors being formed by having the second capacitor electrodes and corresponding storage capacitor line extension sections overlap each other, with an insulating film provided therebetween, each of the storage capacitor line sections being connected to a respective one of the storage capacitor lines.

In order to attain the object, a liquid crystal display device of the present invention is a memory liquid crystal display device that carries out a refresh operation in a period in which data is held after a data signal potential is written in, the device including:

data signal lines; scanning signal lines; storage capacitor lines; data transfer lines; refresh lines; high potential power lines; low potential power lines; pixel electrodes; a counter electrode; N-channel first transistors, each of whose control terminal is connected to a respective one of the scanning signal lines; N-channel second transistors, each of whose control terminal is connected to a respective one of the data transfer lines; N-channel third transistors and P-channel fifth transistors, each of whose control terminals are connected to a respective one of the pixel electrodes via a respective one of the second transistors and whose one of conductive terminals are connected to each other; fourth transistors, each of whose control terminal is connected to a respective one of the refresh lines and whose one of conductive terminals is connected to the one of conductive terminals of a respective one of the third transistors and that of a respective one of the fifth transistors; first storage capacitors, each of which is connected to a respective one of the pixel electrodes; and second storage capacitors, each of which is connected to a respective one of the pixel electrodes via a respective one of the second transistors, the other one of the conductive terminals of the third transistors being connected to a respective one of the low potential power lines, and the other one of the conductive terminals of the fifth transistors being connected to a respective one of the high potential power lines, each of the pixel electrodes being connected to (i) a respective one of the data signal line via a respective one of the first transistors, (ii) a respective one of the high potential power lines via a respective one of the fourth transistors and a respective one of the fifth transistors, and (iii) a respective one of the low potential power lines via the respective fourth transistor and a respective one of the third transistors, and furthermore, each of the pixel electrodes having at least two contact holes including a first contact hole and a second contact hole, the pixel electrode being connected to one of conductive terminals of the respective first transistor via the first contact hole, and the pixel electrode being connected to one of conductive terminals of a respective one of the second transistors and one of conductive terminals of the respective fourth transistor, via the second contact hole.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

INDUSTRIAL APPLICABILITY

The present invention can be suitably used for displays for a portable phone, and the like.

REFERENCE SIGNS LIST

1 liquid crystal display device
2 gate driver/CS driver (scanning signal line drive circuit/storage capacitor line drive circuit)
3 control signal buffer circuit
4 drive signal generation circuit/video signal generation circuit (display control circuit)
5 demultiplexer
6 pixel array
7 pixel electrode
13 contact hole (first contact hole)
14 contact hole (second contact hole)
7*a*, 7*b*, 7*c*, 7*d* gate electrode (control terminal)
8*a*, 8*b*, 8*c*, 8*d*, 8*e* drain electrode (conductive terminal)
9*a*, 9*b*, 9*c*, 9*d*, 9*e* source electrode (conductive terminal)
10*bb* CS extension section (storage capacitor line extension section)
33, 33*a*, 33*b*, 33*c* relay line
37*a* capacitor electrode (first capacitor electrode)
37*b* capacitor electrode (second capacitor electrode)
40, 80 pixels
64 counter electrode (common electrode)
GL gate line (scanning signal line)
CSL CS line (storage capacitor line)
DT data transfer control line (data transfer line)
RC refresh output control line (refresh line)
SL source line (data signal line)
MR pixel memory (memory circuit)
SW1 switch circuit
DS1 first data storage section
TS1 data transfer section
DS2 second data storage section
RS1 refresh output control section
VS1 supply source
N1-N4 transistor (N-channel field effect transistor)
P1 transistor (P-channel field effect transistor, fifth transistor)
N1 transistor (first transistor)
N2 transistor (second transistor)
N3 transistor (third transistor)
N4 transistor (fourth transistor)
Ca1 capacitor (first storage capacitor)
Cb1 capacitor (second storage capacitor)
PH high power line (high potential power line)
PL low power line (low potential power line)

The invention claimed is:

1. A memory liquid crystal display device that carries out a refresh operation in a period in which data is held after a data signal potential is written in, the device comprising:
data signal lines;
scanning signal lines;
storage capacitor lines;
data transfer lines;
refresh lines;
pixel electrodes;
a counter electrode;
first transistors, a control terminal of each of which is connected to a respective one of the scanning signal lines;
second transistors, a control terminal of each of which is connected to a respective one of the data transfer lines;
third transistors, a control terminal of each of which is connected to a respective one of the pixel electrodes via a respective one of the second transistors;
fourth transistors, a control terminal of each of which is connected to a respective one of the refresh lines;
first storage capacitors, each of which is connected to a respective one of the pixel electrodes; and
second storage capacitors, each of which is connected to a respective one of the pixel electrodes via a respective one of the second transistors, wherein
each of the pixel electrodes is connected to a respective one of the data signal lines via a respective one of the first transistors and is connected to a respective one of the data transfer lines via a respective one of the fourth transistors and a respective one of the third transistors,
each of the pixel electrodes has at least two contact holes including a first contact hole and a second contact hole, the pixel electrode being connected to one of conductive terminals of the respective one of the first transistors via the first contact hole and being connected to one of conductive terminals of a respective one of the second transistors and one of conductive terminals of the respective one of the fourth transistors via the second contact hole,
while the data signal potential is written in, the data transfer lines are made active and the scanning signal lines are successively selected while the data signal potential is outputted to the data signal lines,
during the period in which data is held,
the data signal lines are provided with a constant potential that turns the third transistors ON, and
the refresh operation is carried out by once activating the scanning signal lines simultaneously and thereafter activating the refresh lines simultaneously, while the data transfer lines are inactive,
a potential of the counter electrode is alternated between two values each time the refresh operation is carried out, and
the two values are both larger than a minimum value of the data signal potential but are smaller than a maximum value of the data signal potential.

2. The liquid crystal display device according to claim 1, further comprising:
first capacitor electrodes, each of which is connected to a respective one of the pixel electrodes via the first contact hole; and
second capacitor electrodes, each of which is connected to a respective one of the pixel electrodes via the second contact hole,
each of the first storage capacitors being formed by having the storage capacitor lines and corresponding first capacitor electrodes overlap each other, with an insulating film provided therebetween, and
each of the second storage capacitors being formed by having the second capacitor electrodes and corresponding storage capacitor line extension sections overlap each other, with an insulating film provided therebetween, each of the storage capacitor line extension sections being connected to a respective one of the storage capacitor lines.

* * * * *